US007848536B2

(12) United States Patent
Sadaie et al.

(10) Patent No.: US 7,848,536 B2
(45) Date of Patent: Dec. 7, 2010

(54) VOICE COIL ASSEMBLY, LOUDSPEAKER USING THE SAME, AND METHOD FOR PRODUCING THE SAME

(75) Inventors: Koichi Sadaie, Neyagawa (JP); Hiroyasu Kumo, Neyagawa (JP); Yoshihide Toyoshima, Neyagawa (JP); Satofumi Nagaoka, Neyagawa (JP); Yoshinori Ujimoto, Neyagawa (JP); Kouichi Abe, Neyagawa (JP)

(73) Assignee: Onkyo Corporation, Neyagawa-shi (JP)

( * ) Notice: Subject to any disclaimer, the term of this patent is extended or adjusted under 35 U.S.C. 154(b) by 276 days.

(21) Appl. No.: 12/259,332

(22) Filed: Oct. 28, 2008

(65) Prior Publication Data

US 2009/0116681 A1 May 7, 2009

(30) Foreign Application Priority Data

| | | |
|---|---|---|
| Nov. 2, 2007 | (JP) | 2007-286787 |
| Nov. 2, 2007 | (JP) | 2007-286788 |
| Apr. 15, 2008 | (JP) | 2008-106175 |
| Jul. 25, 2008 | (JP) | 2008-191565 |

(51) Int. Cl.
*H04R 25/00* (2006.01)

(52) U.S. Cl. ..... 381/401; 381/407; 381/412

(58) Field of Classification Search ..... 381/396, 381/398, 400–409, 412, 42, 421–424, 431; 181/148

See application file for complete search history.

(56) References Cited

U.S. PATENT DOCUMENTS

| | | | | |
|---|---|---|---|---|
| 4,322,584 | A * | 3/1982 | Shimada et al. | 381/431 |
| 5,664,024 | A | 9/1997 | Furuta et al. | |
| 2006/0188126 | A1 * | 8/2006 | Andersen et al. | 381/396 |
| 2008/0205686 | A1 * | 8/2008 | Tagami et al. | 381/398 |

FOREIGN PATENT DOCUMENTS

| | | | |
|---|---|---|---|
| JP | 07-131892 | | 5/1995 |
| JP | 8-265895 | A | 10/1996 |
| JP | 10-327497 | A | 12/1998 |
| JP | 11-136793 | A | 5/1999 |
| JP | 2000-261887 | | 9/2000 |
| JP | 3084309 | U | 12/2001 |

* cited by examiner

*Primary Examiner*—Tuan D Nguyen
(74) *Attorney, Agent, or Firm*—Renner, Otto, Boisselle & Sklar, LLP

(57) ABSTRACT

A voice coil assembly capable of realizing a flat thin loudspeaker having a high efficiency, reduced divided vibrations, a flat frequency response, and reduced operation defects. The voice coil assembly includes a plurality of internal-winding voice coils, each including a rectangular bobbin having a rectangular cross section and defining a rectangular space therein and an internal rectangular coil fixed to an inner wall surface of the rectangular bobbin defining the rectangular space, wherein an outer wall surface of the rectangular bobbin of one internal-winding voice coil is adhered and fixed to an outer wall surface of the rectangular bobbin of another internal-winding voice coil.

19 Claims, 12 Drawing Sheets

(a)

(b)

(c)

(a)

(b)

(a)

(b)

(a)

(b)

(a)

(b)

(a)

(b)

(a)

(b)

VOICE COIL ASSEMBLY, LOUDSPEAKER USING THE SAME, AND METHOD FOR PRODUCING THE SAME

BACKGROUND OF THE INVENTION

1. Field of the Invention

The present invention relates to a loudspeaker including a magnetic circuit using a plurality of magnets, and a voice coil assembly using bobbins and coils. More particularly, the present invention relates to a flat thin loudspeaker with a small overall height.

2. Description of the Related Art

Some electrodynamic loudspeakers for converting audio signals to sound employ flat diaphragms in order to realize a loudspeaker having a small overall height including the magnetic circuit. With a flat diaphragm, as compared with a cone diaphragm, the overall height of the loudspeaker will be small, but the loudspeaker is likely to have insufficient rigidity for vibrating as an integral unit without divided vibrations. In view of this, a conventional type of loudspeaker includes a bobbin fixed to a flat diaphragm and including a plurality of voice coils, wherein the flat diaphragm is driven by the plurality of voice coils, in an attempt to suppress divided vibrations. Another conventional type of loudspeaker is a flat thin loudspeaker with a small overall height, including a flat diaphragm provided with a plurality of coils and a magnetic circuit with a plurality of magnets corresponding to the coils.

Japanese Laid-Open Patent Publication No. 60-18098 discloses a flat thin loudspeaker with a small overall height, in which a plurality of coils are wound along deep grooves of a flat diaphragm having protrusions/depressions so that the coils are placed in magnetic gaps formed between a plurality of magnets. The coils are obtained by separating, in the separation step, a coil wound around in a racetrack pattern, and are then attached and bonded to the flat diaphragm. Japanese Laid-Open Patent Publication No. 63-299500 discloses a flat loudspeaker using a bobbin obtained by vacuum-forming a thin plastic plate, with coils being inserted along slits in the bobbin. In such a loudspeaker, coils are placed in magnetic gaps in the magnetic circuit, which are the places with the highest magnetic flux density, thereby increasing the efficiency of a flat loudspeaker. However, in order to realize desirable sound reproduction by a flat thin loudspeaker with a small overall height, a bobbin accommodating a plurality of coils placed in magnetic gaps needs to have a light weight and a high rigidity.

Japanese Laid-Open Utility Model Publication No. 55-88590 discloses a flat-plate loudspeaker using a number of rectangular voice coils that are joined together along the longitudinal and lateral sides thereof into a voice coil cluster, which is attached to a flat-plate diaphragm and driven by a magnetic circuit. As shown in FIG. 3 of this publication, the loudspeaker includes a plurality of magnetic circuits each having a magnet interposed between one long sides of a pair of strip-shaped yokes, with each side portion of each voice coil being inserted between the other long sides of the strip-shaped yokes of the magnetic circuits. This publication states that coils are wound around frames to form rectangular voice coils, which are then joined together along the longitudinal and lateral sides thereof into a voice coil cluster.

However, as seen in FIG. 2 of this publication, each voice coil of the conventional voice coil cluster is wound around the outside of a frame (equivalent to a bobbin), and adjacent ones of the bobbins forming the voice coil cluster cannot be attached closely together, and will rather be spaced apart from each other by the thickness of the wire diameter of the voice coils, even when adjacent voice coils are jointed together. If the bobbin rigidity is insufficient, bobbins may vibrate to cause divided vibrations, and adjacent bobbins may contact each other to produce an abnormal noise. Solving this problem will require the provision of an additional mass, e.g., an adhesive for connecting together the adjacent bobbins. This increases the total weight of the loudspeaker diaphragm, thereby reducing the reproduction efficiency of the loudspeaker.

Japanese Laid-Open Patent Publication No. 7-131892 discloses a voice coil obtained by winding a coil on the inner side of a bobbin, together with a method for reducing the number of winding steps required for winding a coil on the inner side of an annular bobbin.

SUMMARY OF THE INVENTION

A voice coil assembly of the present invention is a voice coil assembly, comprising a plurality of internal-winding voice coils, each including a rectangular bobbin having a rectangular cross section and defining a rectangular space therein and an internal rectangular coil fixed to an inner wall surface of the rectangular bobbin defining the rectangular space, wherein an outer wall surface of the rectangular bobbin of one internal-winding voice coil is adhered and fixed to an outer wall surface of the rectangular bobbin of another internal-winding voice coil.

Preferably, two adjacent internal-winding voice coils, of which the outer wall surfaces of the rectangular bobbins are adhered and fixed to each other, are arranged so that a direction of an audio signal current flow along one side of the internal rectangular coil of one of the adjacent internal-winding voice coils that is neighboring a boundary between the two adjacent internal-winding voice coils is the same as that along one side of the internal rectangular coil of the other one of the adjacent internal-winding voice coils that is neighboring the boundary.

More preferably, the rectangular bobbin is formed by a paper material such as a kraft paper or a spiral paper, a resin material such as Kapton, Silter or Til, or a metal material containing aluminum or titanium.

More preferably, a voice coil assembly further comprising lead wires connected to an input terminal and an output terminal of the plurality of internal-winding voice coils connected together.

A loudspeaker of the present invention is a loudspeaker, comprising the voice coil assembly, a loudspeaker diaphragm fixed to the voice coil assembly, an edge for supporting the outer periphery of the loudspeaker diaphragm so as to allow vibrations of the loudspeaker diaphragm, and a frame to which the outer periphery of the edge and a magnetic circuit are connected, wherein: the magnetic circuit includes a plurality of magnets each having a rectangular flat plate thereon, which are magnetized and arranged so that adjacent magnets have different polarities, and a yoke to which the magnets are fixed and which define open holes at opposite ends thereof; and the internal rectangular coils of the voice coil assembly are placed in the magnetic gaps formed between adjacent plates and between the plates and the yoke, with the outer wall surfaces on opposite ends of the voice coil assembly being exposed through the open holes of the magnetic circuit.

Preferably, the frame has frame holes which are communicated to the open holes of the magnetic circuit; and the outer wall surfaces on opposite ends of the voice coil assembly are exposed through the open holes of the magnetic circuit and the frame holes.

More preferably, the loudspeaker is further comprising a dust-proof member covering the open holes of the magnetic circuit and the frame holes of the frame.

A voice coil assembly of the present invention is a voice coil assembly, comprising a lattice-shaped bobbin having a lattice-shaped cross section and having a plurality of rectangular spaces defined therein, and a plurality of internal rectangular coils fixed to the inner wall surfaces defining the rectangular spaces of the lattice-shaped bobbin, wherein two internal rectangular coils fixed to the inner wall surfaces of two adjacent rectangular spaces neighboring each other with a partition wall therebetween are arranged so that a direction of an audio signal current flow along one side x1 of one internal rectangular coil v1 that is neighboring the partition wall is the same as that along one side x2 of the other internal rectangular coil v2 that is neighboring the partition wall.

Preferably, the lattice-shaped bobbin is formed by a resin material such as polyimide, polyetherimide or a liquid crystal polymer, or a metal material containing aluminum or titanium.

More preferably, a thickness tb1 of the partition wall of the lattice-shaped bobbin is smaller than a thickness tb2 of other portions of the inner wall surface, and is less than or equal to a total thickness tc0, being a sum of a thickness tc1 of one side x1 of one internal rectangular coil v1 and a thickness tc2 of one side x2 of the other internal rectangular coil v2.

More preferably, the sides x1 and x2 of the two internal rectangular coils v1 and v2 along the partition wall are fixed together by an adhesive with the partition wall being not interposed therebetween, and upper end surfaces of the sides x1 and x2 are fixed to a lower end surface of the partition wall by an adhesive.

More preferably, the partition wall of the lattice-shaped bobbin further includes a partition wall extension being interposed between the sides x1 and x2 of the two internal rectangular coils v1 and v2 along the partition wall, and a thickness tb0 of the partition wall extension is less than or equal to the thickness tb1 of the partition wall.

More preferably, further comprising lead wires connected to an input terminal and an output terminal of the plurality of internal-winding voice coils connected together.

A loudspeaker of the present invention is a loudspeaker, comprising the voice coil assembly, a loudspeaker diaphragm fixed to the voice coil assembly, an edge for supporting the outer periphery of the loudspeaker diaphragm so as to allow vibrations of the loudspeaker diaphragm, and a frame to which the outer periphery of the edge and a magnetic circuit are connected, wherein: the magnetic circuit includes a plurality of magnets each having a rectangular flat plate thereon, which are magnetized and arranged so that adjacent magnets have different polarities, and a yoke to which the magnets are fixed and which define open holes at opposite ends thereof; and the internal rectangular coils of the voice coil assembly are placed in the magnetic gaps formed between adjacent plates and between the plates and the yoke, with the outer wall surfaces on opposite ends of the voice coil assembly being exposed through the open holes of the magnetic circuit.

Preferably, the frame has frame holes which are communicated to the open holes of the magnetic circuit; and the outer wall surfaces on opposite ends of the voice coil assembly are exposed through the open holes of the magnetic circuit and the frame holes.

More preferably, the loudspeaker is further comprising a dust-proof member covering the open holes of the magnetic circuit and the frame holes of the frame.

A method for producing a loudspeaker of the present invention is a method for producing a loudspeaker, comprising the steps of: providing a magnetic circuit, including a plurality of magnets each having a rectangular flat plate thereon, which are magnetized and arranged so that adjacent magnets have different polarities, and a yoke to which the magnets are fixed and which define open holes at opposite ends thereof; connecting a frame, on which a terminal is fixed, to the magnetic circuit; inserting an assembly jig, which is held against an outer wall surface of a voice coil assembly for holding the voice coil assembly, into each of the open holes at opposite ends of the magnetic circuit, thereby placing the voice coil assembly in a magnetic gap of the magnetic circuit; connecting and fixing one end of lead wires to an input terminal and an output terminal of a plurality of internal-winding voice coils of the voice coil assembly connected together; connecting and fixing the other end of the lead wires extending from the voice coil assembly to the terminal; bonding a loudspeaker diaphragm to the voice coil assembly; bonding an edge, which supports an outer periphery of the loudspeaker diaphragm so as to allow vibrations of the loudspeaker diaphragm, to the frame; and removing the assembly jig after an adhesive cures to thereby provide a loudspeaker vibrating system that can vibrate.

Preferably, the assembly jig includes two straight holding sections to be inserted between the outer wall surface of the voice coil assembly and the yoke defining the magnetic gap of the magnetic circuit, an end surface holding section held against the outer wall surface exposed at opposite ends of the voice coil assembly, and a connecting section connecting together the two straight holding sections and the end surface holding section; and the method further comprises the step of allowing the adhesive to cure with the assembly jig being fit in place in the step of providing the loudspeaker vibrating system.

More preferably, a method for producing a loudspeaker of the present invention is further comprising the step of bonding and fixing a dust-proof member covering the open holes of the magnetic circuit and the frame holes of the frame.

Effects of the present invention will be described.

A voice coil assembly of a loudspeaker of the present invention is obtained by adhering and fixing together a plurality of internal-winding voice coils, each including a rectangular bobbin and an internal rectangular coil. Another voice coil assembly of a loudspeaker of the present invention is obtained by adhering and fixing a plurality of internal rectangular coils to a lattice-shaped bobbin having a lattice-shaped cross section. In the former voice coil assembly, the internal rectangular coil is fixed to the inner wall surface defining the rectangular space of each rectangular bobbin, and the outer wall surface of the rectangular bobbin of one internal-winding voice coil is adhered and fixed to that of the rectangular bobbin of another internal-winding voice coil by a band member and an adhesive. In the latter voice coil assembly, the lattice-shaped bobbin has a plurality of rectangular spaces, and each internal rectangular coil is fixed to the inner wall surface defining a rectangular space.

For example, each internal-winding voice coil of the former voice coil assembly includes a rectangular bobbin having a rectangular cross section and defining a rectangular space therein, and the rectangular bobbin is formed by a paper material such as a kraft paper or a spiral paper, a resin material such as Kapton, Silter or Til, or a metal material containing aluminum or titanium. The lattice-shaped bobbin of the latter voice coil assembly is formed by a resin material such as polyimide, polyetherimide or a liquid crystal polymer, or a metal material containing aluminum or titanium. The voice coil assembly further includes lead wires connected to the input terminal and the output terminal of the plurality of internal-winding voice coils connected together, whereby an audio signal current can be conducted.

The term "internal rectangular coil" as used herein refers to a bobbinless coil winding having a rectangular shape in conformity to the shape of the magnetic gap of the magnetic circuit, wherein such coil windings are fixed to the inner wall surfaces of rectangular bobbins each defining a rectangular space therein, or fixed to the inner wall surfaces of a lattice-shaped bobbin defining rectangular spaces therein. The outer dimension of the internal rectangular coil is substantially equal to the inner dimension of the rectangular space, and the internal rectangular coil is adhered and fixed to the rectangular space of the bobbin by an adhesive while being fit therein. In the voice coil assembly of the present invention, two adjacent internal-winding voice coils are arranged so that a direction of an audio signal current flow along one side of the internal rectangular coil of one of the adjacent internal-winding voice coils that is neighboring a boundary between the two adjacent internal-winding voice coils is the same as that along one side of the internal rectangular coil of the other one of the adjacent internal-winding voice coils that is neighboring the boundary.

A loudspeaker of the present invention is realized with a voice coil assembly as set forth above. Specifically, a loudspeaker of the present invention includes a loudspeaker diaphragm fixed to the voice coil assembly, an edge for supporting the outer periphery of the loudspeaker diaphragm so as to allow vibrations of the loudspeaker diaphragm, and a frame to which the outer periphery of the edge and a magnetic circuit are connected. The magnetic circuit includes a plurality of magnets each having a rectangular flat plate thereon, which are magnetized and arranged so that adjacent magnets have different polarities, and a yoke to which the magnets are fixed and which define open holes at opposite ends thereof, whereby the internal rectangular coils of the voice coil assembly are placed in the magnetic gaps formed between adjacent plates and between the plates and the yoke. Thus, two internal-winding voice coils with an inner wall surface of the bobbin being interposed therebetween are placed in the magnetic gaps formed between adjacent plates. The loudspeaker of the present invention may further include a dust-proof member covering the open holes of the magnetic circuit and the frame holes of the frame.

As a result, it is possible to realize a flat thin loudspeaker having reduced divided vibrations and a flat frequency response. In the voice coil assembly of the present invention, each internal rectangular coil is fixed to the inner wall surface defining a rectangular space of the bobbin, and adjacent bobbins of the voice coil assembly, i.e., adjacent internal-winding voice coils, are adhered and fixed together. As a result, it is possible to increase the bobbin rigidity, reduce divided vibrations of the bobbins, and suppress operation defects such as the occurrence of an abnormal noise due to adjacent bobbins contacting each other. Since the amount of adhesive used to connect adjacent bobbins to each other can be reduced, it is possible to reduce the weight of the loudspeaker vibrating member, and to improve the reproduction efficiency of the loudspeaker, thereby realizing a stable sound reproduction.

Also when the voice coil assembly uses a lattice-shaped bobbin, it is similarly possible to increase the bobbin rigidity and to suppress divided vibrations of the bobbins. In the lattice-shaped bobbin, two internal rectangular coils fixed in two rectangular spaces with a partition wall therebetween are arranged so that a direction of an audio signal current flow along one side x1 of one internal rectangular coil v1 that is neighboring the partition wall is the same as that along one side x2 of the other internal rectangular coil v2 that is neighboring the partition wall. The thickness tb1 of the partition wall of the lattice-shaped bobbin is smaller than the thickness tb2 of other portions of the inner wall surface. Moreover, the thickness tb1 of the partition wall is less than or equal to the total thickness tc0, being the sum of the thickness tc1 of one side x1 of one internal rectangular coil v1 and the thickness tc2 of one side x2 of the other internal rectangular coil v2. As a result, the thickness tb1 of the partition wall of the lattice-shaped bobbin can be made smaller than the thickness tb2 of other portions of the inner wall surface to thereby reduce the total weight of the voice coil assembly including the lattice-shaped bobbin. The effect of reducing the total weight by reducing the thickness of each partition wall becomes more significant when the number of rectangular spaces of the lattice-shaped bobbin is increased, thereby also increasing the number of partition walls.

If the magnetic gap of the magnetic circuit can be further narrowed, the magnetic flux density is improved, thereby desirably improving the efficiency of the loudspeaker. Thus, in the voice coil assembly of the present invention, the sides x1 and x2 of the two internal rectangular coils v1 and v2 along the partition wall are fixed together by an adhesive with the partition wall being not interposed therebetween, and upper end surfaces of the sides x1 and x2 are fixed to a lower end surface of the partition wall by an adhesive. Alternatively, in the voice coil assembly of the present invention, the partition wall of the lattice-shaped bobbin further includes a partition wall extension being interposed between the sides x1 and x2 of the two internal rectangular coils v1 and v2 along the partition wall, and the thickness tb0 of the partition wall extension is less than or equal to the thickness tb1. Thus, the partition wall of the lattice-shaped bobbin between the sides x1 and x2 of the internal rectangular coils v1 and v2 along the partition wall is omitted or is replaced by a partition wall extension thinner than the partition wall, whereby it is possible to further reduce the weight of the lattice-shaped bobbin, and a loudspeaker with reduced gap defects and a high efficiency can be realized even if the magnetic gap is further narrowed.

Where no partition wall is interposed between the two internal rectangular coils v1 and v2, the voice coil assembly of the present invention is preferably produced by using a bonding jig having a lattice-shaped groove corresponding to the lattice-shaped bobbin. After a plurality of internal rectangular coils are fit into the lattice-shaped groove of the bonding jig in advance, an adhesive is applied to the upper end surface of the plurality of internal rectangular coils, and the lattice-shaped bobbin is fit into the lattice-shaped groove of the bonding jig, thereby fixing the plurality of internal rectangular coils to the inner wall surfaces defining the rectangular spaces of the lattice-shaped bobbin, and bonding the upper end surface of the plurality of internal rectangular coils with the lower end surface of the partition wall of the lattice-shaped bobbin. Then, the plurality of internal-winding voice coils are connected together, and lead wires are connected to the input terminal and the output terminal. After the adhesive cures, the voice coil assembly can be removed from the lattice-shaped groove of the bonding jig. Where the partition wall extension even thinner than the partition wall is used, the plurality of internal rectangular coils may be bonded to the partition wall extensions of the lattice-shaped bobbin, or the plurality of internal rectangular coils may be placed in a mold so as to provide the lattice-shaped bobbin by insert molding.

As a result, it is possible to realize a flat thin loudspeaker having reduced divided vibrations and a flat frequency response. In the voice coil assembly of the present invention, each internal rectangular coil is fixed to the inner wall surface of the bobbin defining a rectangular space, and two internal-winding voice coils along the partition wall can be adhered and fixed to each other. As a result, it is possible to increase the bobbin rigidity and reduce the weight of the loudspeaker vibrating member, whereby it is possible to improve the reproduction efficiency of the loudspeaker, thereby realizing a stable sound reproduction.

In addition, the magnetic circuit has open holes defined by the yoke at opposite ends thereof, and the outer wall surfaces at the opposite ends of the voice coil assembly are exposed through the open holes. Where the frame has frame holes which are communicated to the open holes of the magnetic circuit, the outer wall surfaces at the opposite ends of the voice coil assembly are exposed through the open holes of the magnetic circuit and the frame holes. Thus, with a voice coil assembly of a loudspeaker of the present invention, the internal rectangular coils are fixed to the inner wall surfaces defining the rectangular spaces of the bobbin, and no coil exists on the outer wall surfaces of the voice coil assembly. During the production of a loudspeaker, an assembly jig for appropriately positioning the voice coil assembly in the magnetic gap of the magnetic circuit can be held against the outer wall surface of the voice coil assembly for holding the voice coil assembly. As a result, it is possible to realize a loudspeaker with reduced operation defects such as the occurrence of an abnormal noise due to the voice coil assembly contacting the magnetic circuit. Where the assembly jig includes two straight holding sections, an end surface holding section, and a connecting section therebetween, the step of providing a loudspeaker vibrating system can be carried out by allowing an adhesive to cure with the assembly jig being fit in place, and the assembly jig can be removed after the adhesive cures to thereby provide a loudspeaker vibrating system that can vibrate.

DETAILED DESCRIPTION OF THE PREFERRED EMBODIMENTS

Preferred embodiments of the present invention will now be described in detail with reference to the drawings. Note however that the present invention is not limited to these embodiments.

Embodiment 1

Figure 1:
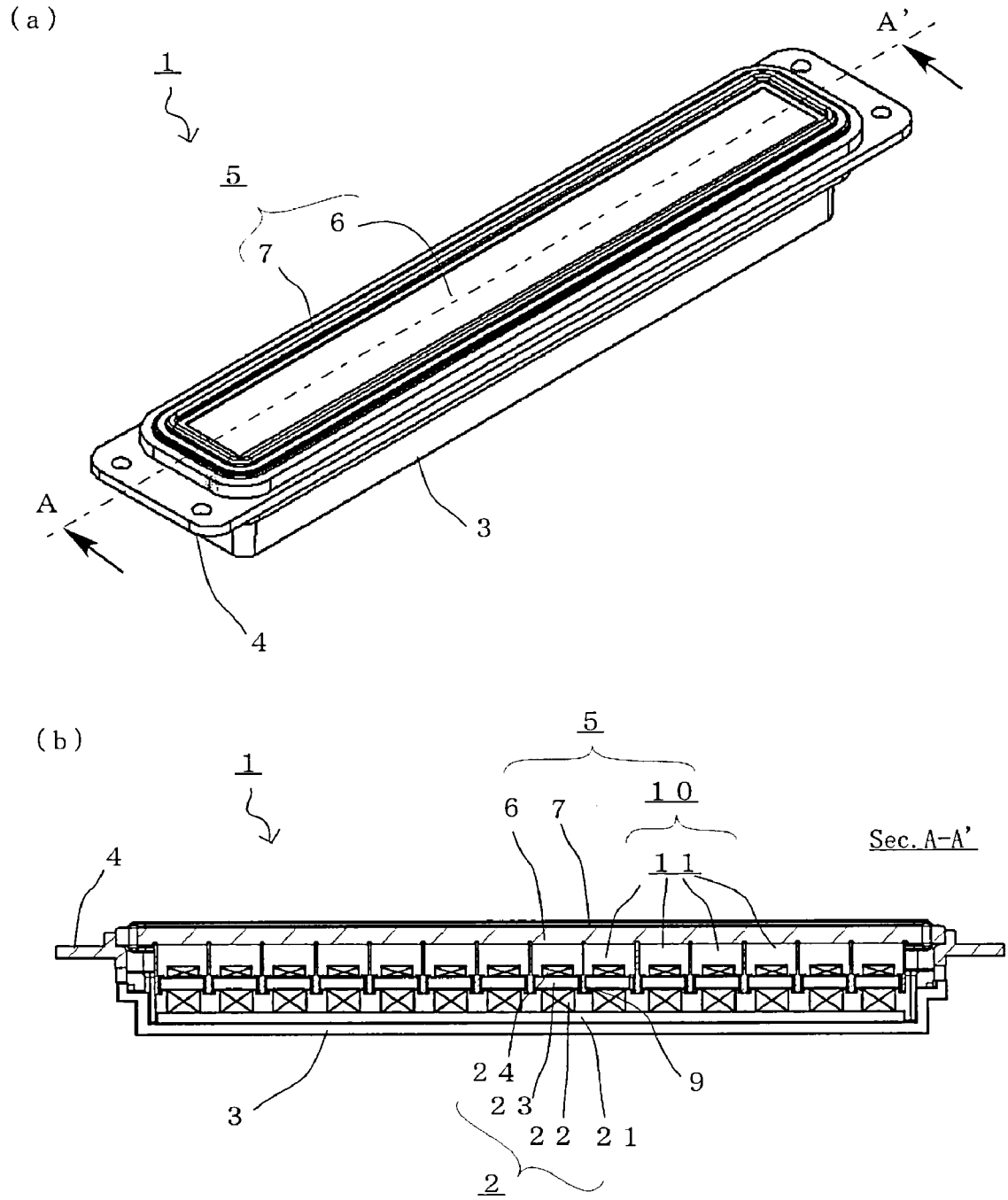
FIGS. 1A and 1B are views illustrating a flat thin loudspeaker.

FIGS. 1A and 1B are views illustrating a flat thin loudspeaker 1 according to a preferred embodiment of the present invention. FIG. 1A is a perspective view illustrating the loudspeaker 1 with a flat diaphragm 6 facing up, and FIG. 1B is a cross-sectional view taken along line A-A' illustrating an internal structure of the flat thin loudspeaker 1. These figures do not show part of the internal structure, etc., not necessary for the illustration of the present invention.

The flat thin loudspeaker 1 of the present embodiment is a flat thin loudspeaker having a loudspeaker vibrating member 5 including a generally rectangular flat diaphragm 6, wherein the width W (about 16.2 mm) of the flat diaphragm 6 and the overall height h (about 20.0 mm) of the loudspeaker are small relative to the length L (about 140.8 mm) of the flat diaphragm 6. Specifically, the loudspeaker 1 further includes a loudspeaker magnetic circuit 2, a holding frame 3 fixed to the bottom surface side of the magnetic circuit 2, and a resin frame 4 for supporting the periphery of the flat diaphragm 6. The loudspeaker magnetic circuit 2 includes 14 main magnets 22, which are magnetized and arranged in a row so that adjacent magnets have different polarities. The frame 4 includes a frame fixing portion for fixing the flat thin loudspeaker 1 to a cabinet (not shown), or the like.

The loudspeaker vibrating member 5 includes the flat diaphragm 6, an edge 7 for supporting the outer periphery of the flat diaphragm 6 so as to allow vibrations of the diaphragm 6, and a voice coil assembly 10, to be described later, fixed to the back surface side of the flat diaphragm 6. For example, the flat diaphragm 6 is a molded plate of a foamed resin (material: PC (polycarbonate)), with the outer periphery portion thereof being supported by the edge 7 including a rubber (material: foamed rubber), and with the outer periphery side of the edge 7 being fixed to the frame 4. The voice coil assembly 10 is fixed to the back surface side of the flat diaphragm 6, and when an audio signal current is supplied to a plurality of internal rectangular coils 9 (14 coils in the present embodiment) attached to the voice coil assembly 10, the voice coil assembly 10 is driven by the magnetic circuit 2 to thereby vibrate the flat diaphragm 6 and reproduce a sound from the flat thin loudspeaker 1.

Figure 5:
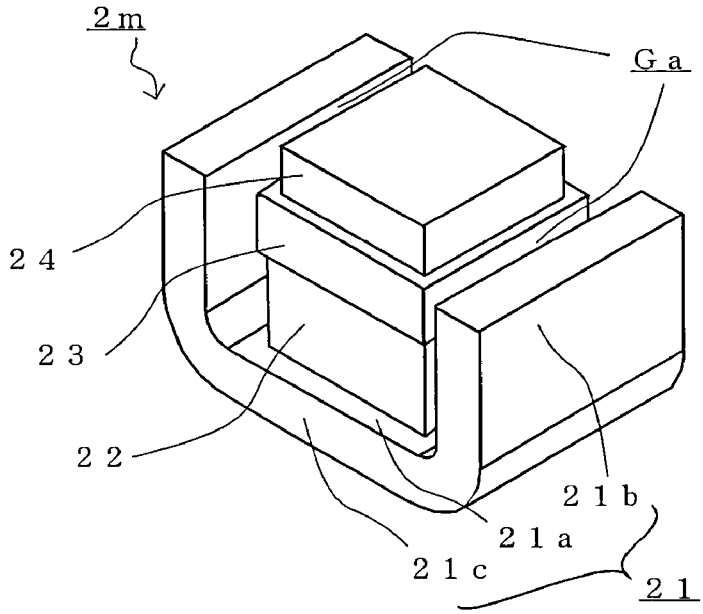
FIGS. 5A and 5B are views illustrating a magnetic circuit of another flat thin loudspeaker.
Figure 5:
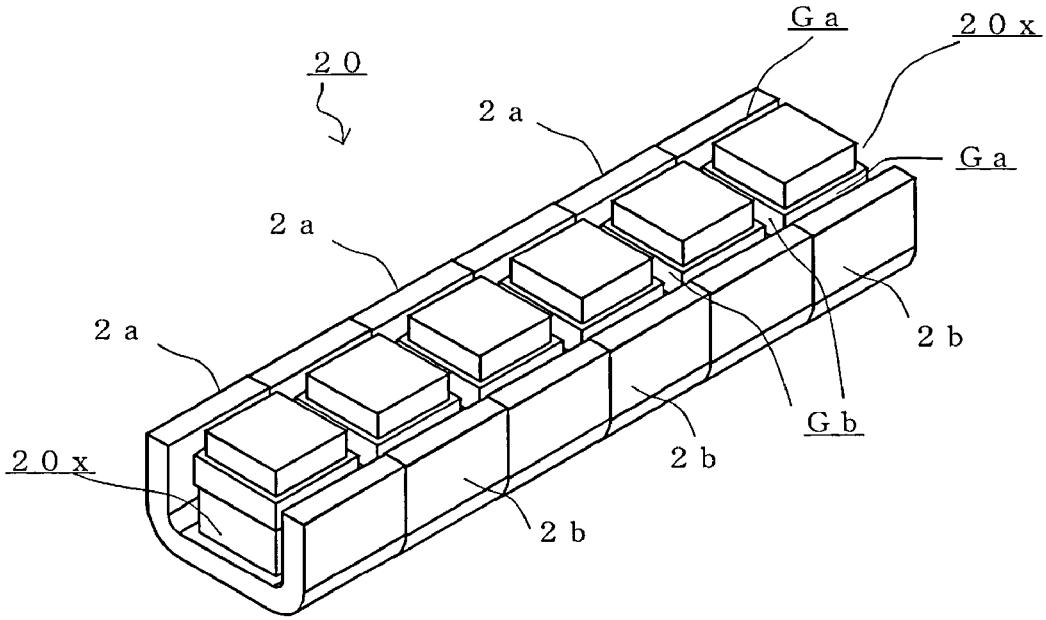

As shown in FIG. 1B, the magnetic circuit 2 includes a yoke 21 of a magnetic metal, the 14 main magnets 22, a rectangular plate 23 placed on each magnet 22, and a repulsive magnet 24 placed on the rectangular plate 23. Referring to FIGS. 5A and 5B, the yoke 21 includes a flat plate portion 21*a*, and a side wall portion 21*b* that defines a magnetic gap Ga between the side wall portion 21*b* and the rectangular plate 23. Specifically, the yoke 21 and the rectangular plate 23 are obtained by pressing a steel plate.

The 14 main magnets 22 are arranged in a row on the plate portion 21*a* of the yoke 21 so that adjacent magnets have different polarities. The 14 main magnets 22 are each fixed in advance to the rectangular plate 23, and are grouped into two that are magnetized so that the first group have the north pole near the rectangular plate 23 and the second group have the south pole near the rectangular plate 23. The magnetized 14 main magnets 22 are arranged and fixed to the plate portion 21*a* of the yoke 21 by means of a jig so that adjacent magnets have different polarities. In a magnetic gap Gb formed between adjacent magnets having different polarities, a magnetic flux travels from the north pole toward the south pole. Therefore, through the magnetic gaps Ga and Gb provided in the magnetic circuit 2, a magnetic flux travels in the direction in which the main magnets 22 are arranged. The previously-magnetized repulsive magnets 24 are fixed to the upper surfaces of the rectangular plates 23 by an adhesive, on the north or south pole thereof so that lines of magnetic force due to the repulsive magnetic field pass from the side surface of the rectangular plate 23. Thus, a high magnetic flux density distribution is obtained in the magnetic gap (Gb) between adjacent rectangular plates 23 of the magnetic circuit 2 and the magnetic gap (Ga) between the rectangular plate 23 and the side wall portion 21*b* of the yoke 21, i.e., a lattice-shaped magnetic gap.

Figure 2:
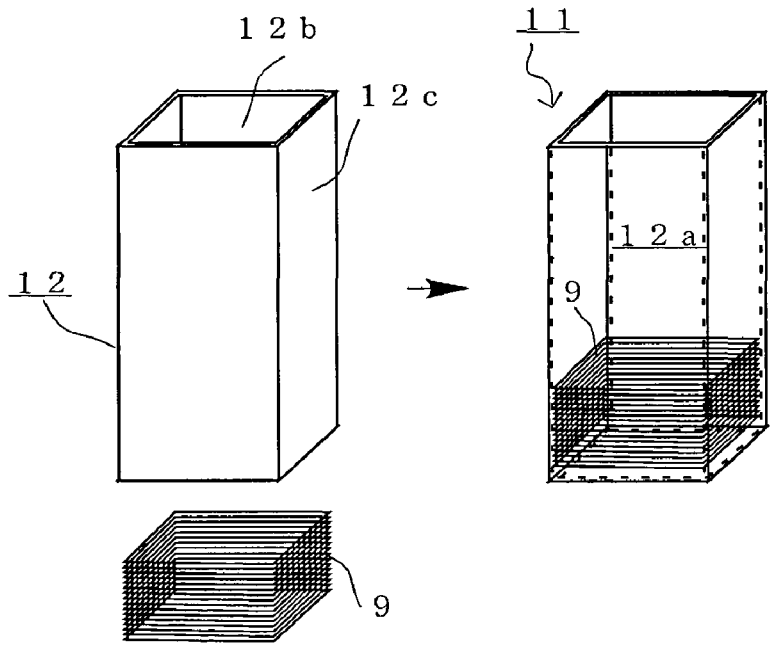
FIGS. 2A to 2C are views illustrating a voice coil assembly of a flat thin loudspeaker.
Figure 2:
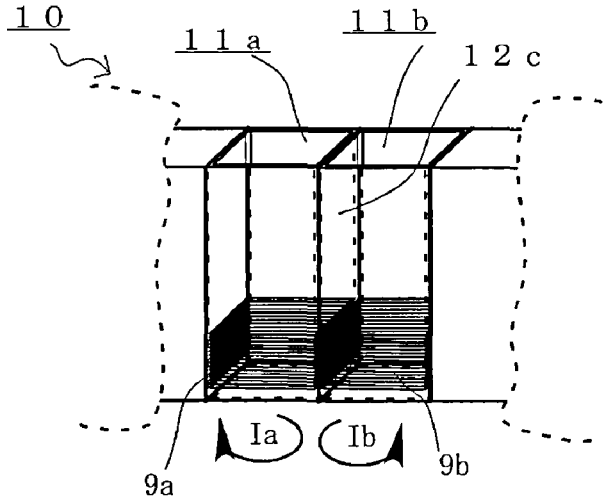
Figure 2:
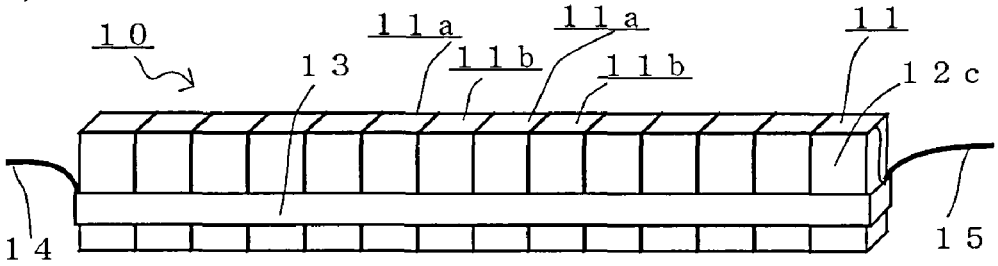
Figure 3:
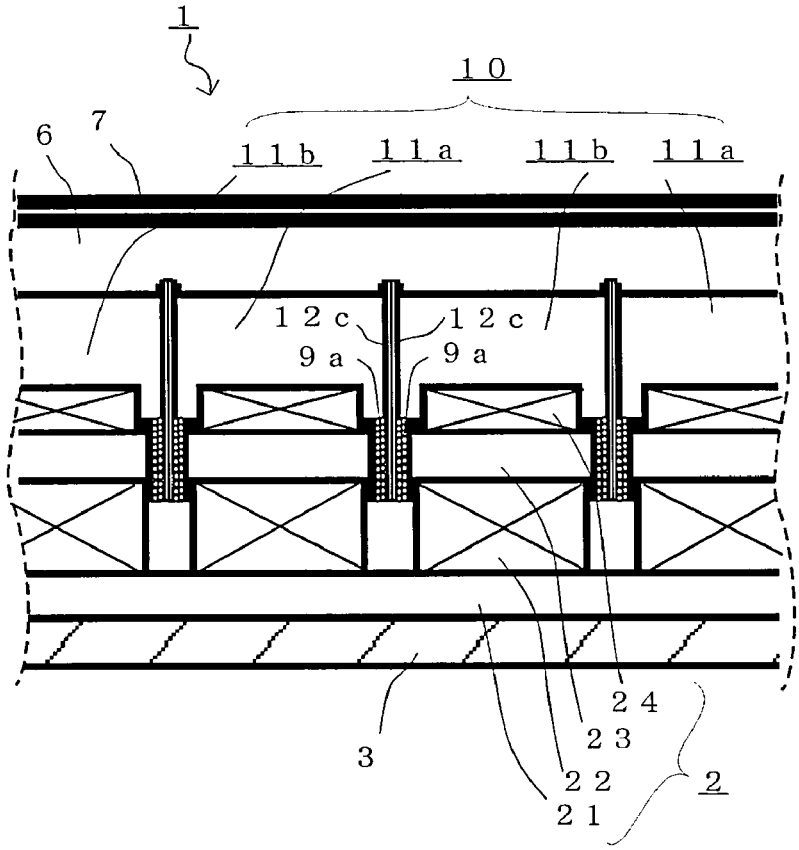
FIG. 3 is an enlarged view illustrating a flat thin loudspeaker.

FIGS. 2A to 2C are views illustrating the voice coil assembly 10 of the flat thin loudspeaker 1. FIG. 2A is a perspective view illustrating an internal-winding voice coil 11 of the voice coil assembly 10, FIG. 2B is an enlarged cross-sectional view illustrating a portion of the voice coil assembly 10, and FIG. 2C is a perspective view illustrating the entire voice coil assembly 10. FIG. 3 is an enlarged cross-sectional view illustrating a portion of the voice coil assembly 10 fixed to the back surface side of the flat diaphragm 6 of the flat thin loudspeaker 1. In FIGS. 2A to 2C, some elements are seen through others for the purpose of illustration.

Each internal-winding voice coil 11 of the voice coil assembly 10 includes a rectangular bobbin 12 having a rectangular cross section with a rectangular space 12*a* defined therein, and the internal rectangular coil 9 fixed to an inner wall surface 12*b* defining the rectangular space of the rectangular bobbin 12. Specifically, the rectangular bobbin 12 is formed by Kapton having a thickness t=0.10 mm, and the rectangular inner dimension thereof is about 8.5 mm by about 8.5 mm. Due to the inner wall surface 12*b*, the rectangular bobbin 12 has a rectangular cross section and has the rectangular space 12*a* defined therein, with an outer wall surface 12*c* defining four planes. Other than a resin material such as Kapton, Silter or Til, the rectangular bobbin 12 may be formed by a paper material such as a kraft paper or a spiral paper or a metal material containing aluminum or titanium.

The internal rectangular coil 9 is a rectangular bobbinless winding of a copper wire having a diameter of 0.12 mm whose outer dimension is about 9.1 mm by about 9.1 mm, and the outer dimension of the internal rectangular coil 9 is generally equal to the inner dimension of the rectangular space 12*a* of the rectangular bobbin 12. The internal rectangular coil 9 is produced as follows. A wire is wound around a tentative rectangular core and then an adhesive or a varnish is applied thereon. After the adhesive or the varnish cures, the core is removed to obtain the bobbinless internal rectangular coil 9. Therefore, the internal rectangular coil 9 of the internal-winding voice coil 11 is adhered and fixed to the inner wall surface 12*b* by an adhesive while being fit in the rectangular space 12*a* of the rectangular bobbin 12. The rectangular shape of the rectangular bobbin 12 and the internal rectangular coil 9 as used herein includes those with rounded corners for preventing the material from breaking due to sharp bending. The rounded corners may be of any curvature as long as they do not interfere with the rectangular plate 23, etc., of the magnetic circuit 2.

Now, the structure of the voice coil assembly 10 will be described. Specifically, the voice coil assembly 10 of the present embodiment is a cluster of 14 internal-winding voice coils 11 arranged in a row and fixed together. FIGS. 2B and 3 are enlarged views showing only four internal-winding voice coils 11. The outer wall surface 12*c* of the rectangular bobbin 12 of one internal-winding voice coil 11*a* is adhered and fixed to the outer wall surface 12*c* of the rectangular bobbin 12 of another internal-winding voice coil 11*b* by an adhesive, thereby obtaining the voice coil assembly 10.

Instead of using an adhesive as described above, the outer wall surfaces 12*c* of the rectangular bobbins 12 of the internal-winding voice coil 11 may be adhered and fixed together by means of a band member 13 wound around the outer wall surfaces 12*c* of all the rectangular bobbins 12, wherein the band member 13 is fixed by an adhesive. The voice coil assembly 10 further includes lead wires 14 and 15 connected to the input terminal and the output terminal of the internal-winding voice coil 11 connected together. In order to arrange the internal-winding voice coils 11 in a row and bonding them together, a jig may be used for restricting the positions of the internal-winding voice coils 11.

In the voice coil assembly 10 of the present invention, two adjacent internal-winding voice coils 11 are arranged so that the direction of the audio signal current flow along one side of the internal rectangular coil 9 of one of the adjacent internal-winding voice coils 11 that is neighboring the boundary between the two adjacent internal-winding voice coils 11 is the same as that along one side of the internal rectangular coil 9 of the other one of the adjacent internal-winding voice coils 11 that is neighboring the boundary. For example, in the voice coil assembly 10 shown in FIG. 2B, internal rectangular coils 9*a* and 9*b* are arranged so that where there is a clockwise current flow Ia through the internal rectangular coil 9*a* of the internal-winding voice coil 11*a*, there is a counterclockwise current flow Ib through the internal rectangular coil 9*b* of the internal-winding voice coil 11*b*. In other words, the internal rectangular coils 9*a* and 9*b* are arranged so that the direction of the audio signal current flow along the right side of the internal rectangular coil 9*a* positioned on the left side is the same as that along the left side of the internal rectangular coil 9*b* positioned on the right side.

Since the voice coil assembly 10 is obtained by adhering and fixing the outer wall surfaces 12*c* of the rectangular bobbins 12 together by an adhesive, the internal rectangular coils 9*a* and 9*b* are facing each other with the inner wall surfaces 12*b* or the outer wall surfaces 12*c* of the two adjacent rectangular bobbins 12 being interposed therebetween so as to allow an audio signal current to flow in the same direction along the interposed wall surfaces. Therefore, in the flat thin loudspeaker 1 using the voice coil assembly 10, the internal rectangular coils 9*a* and 9*b* are arranged so as to face each other with two inner wall surfaces 12*b* or outer wall surfaces 12*c* of the rectangular bobbins 12 being interposed between two adjacent rectangular plates 23 of the lattice-shaped magnetic gap of the magnetic circuit 2, as shown in FIG. 3. The internal rectangular coils 9*a* and 9*b* each have an electromagnetic force acting in the upward or downward direction, and the voice coil assembly 10, which has other internal rectangular coils 9 placed in the magnetic gap, receives a driving force in the upward or downward direction, whereby the flat diaphragm 6 can be displaced up or down. As a result, the flat diaphragm 6 vibrates, and the flat thin loudspeaker 1 reproduces a sound.

The connection of the internal rectangular coils 9 can be either a serial connection or a parallel connection. A serial connection and a parallel connection may be both used, taking into consideration the impedance of each internal rectangular coil 9 and the overall impedance of the entire structure. In order for adjacent coils to conduct audio signal current flows of the opposite rotational directions, two types of coils of different winding directions may be used for the internal rectangular coils 9, or the internal rectangular coils 9 of the same winding direction may be connected together while alternating the start and the end of the winding.

In the voice coil assembly 10, each internal rectangular coil 9 is fixed to the inner wall surface 12*b* defining the rectangular space 12*a* of the rectangular bobbin 12. Therefore, the outer wall surfaces 12*c* of the adjacent rectangular bobbins 12 of the voice coil assembly 10 can be bonded together with no gap therebetween. As a result, the overall strength of the voice coil assembly 10 is improved. Therefore, with the loudspeaker vibrating member 5 including the flat diaphragm 6 and the voice coil assembly 10, it is possible to realize the flat thin loudspeaker 1 having reduced divided vibrations and a flat frequency response.

The voice coil assembly 10 can solve problems with a conventional voice coil assembly including a plurality of voice coils arranged adjacent to one another, each including a bobbin and a coil wound around the outer side of the bobbin. Specifically, it is possible to eliminate the operation defects such as the occurrence of an abnormal noise due to adjacent rectangular bobbins 12 contacting each other. Moreover, it is possible to reduce the amount of adhesive used for connecting the adjacent rectangular bobbins 12 together, thereby reducing the total weight of the loudspeaker vibrating member 5, whereby it is possible to improve the reproduction efficiency of the loudspeaker 1, thereby realizing a stable sound reproduction.

While the 14 main magnets 22 and the 14 internal rectangular coils 9 are all rectangular in the flat thin loudspeaker 1 of the present embodiment, the number of magnets and coils may be any number greater than or equal to two, and the shape of these elements may be either a square or an oblong rectangle.

Embodiment 2

Figure 4:
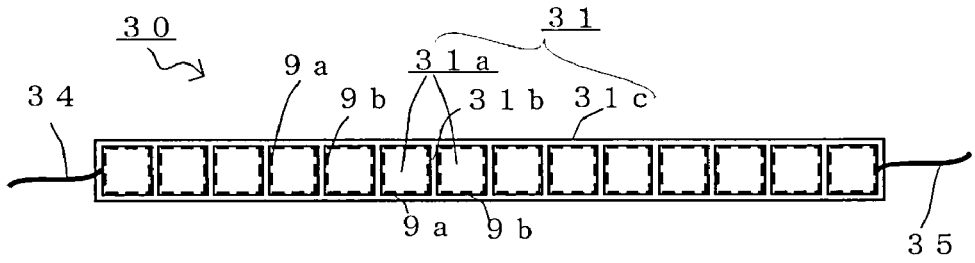
FIGS. 4A and 4B are views illustrating a voice coil assembly of another flat thin loudspeaker.
Figure 4:
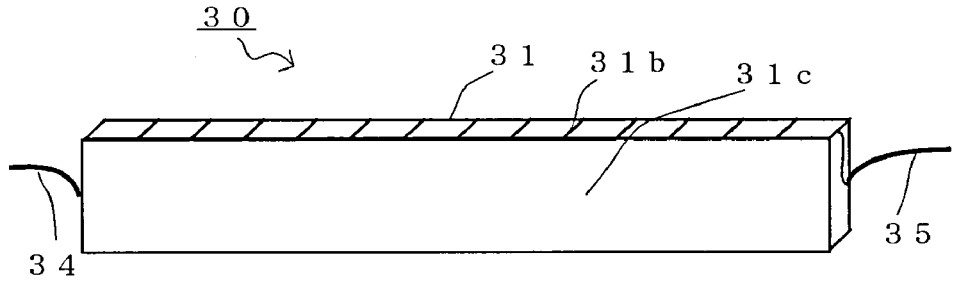

FIGS. 4A and 4B are views illustrating a voice coil assembly 30 of the flat thin loudspeaker 1 according to another embodiment of the present invention. FIG. 4A is a plan view of the voice coil assembly 30, and FIG. 4B is a perspective view illustrating the entire voice coil assembly 30. The voice coil assembly 30 includes a lattice-shaped bobbin 31 having a lattice-shaped cross section with 14 rectangular spaces 31*a* defined therein, and 14 internal rectangular coils 9 each fixed to an inner wall surface 31*b* defining the rectangular space 31*a*. The voice coil assembly 30 of the present embodiment may replace the voice coil assembly 10 of the preceding embodiment to provide the flat thin loudspeaker 1. Therefore, like elements to those of the preceding embodiment, such as the magnetic circuit 2 and the loudspeaker vibrating member 5 including the flat diaphragm 6, are denoted by like reference numerals and will not be further described below.

The lattice-shaped bobbin 31 is obtained by injection-molding a liquid crystal polymer of a resin material into a lattice-shaped (ladder-shaped) bobbin having an average thickness of 0.2 mm, defining the 14 rectangular spaces 31*a* arranged in a row. The internal rectangular coils 9 are adhered and fixed to the inner wall surfaces 31*b* by an adhesive while being fit in the rectangular spaces 31*a* of the lattice-shaped bobbin 31. With the lattice-shaped bobbin 31 formed by a resin as shown in the present embodiment, the inner wall surface 31*b* defining the rectangular space 31*a* may include a stepped portion (not shown) for receiving and stopping the internal rectangular coil 9.

Also in the voice coil assembly 30 of the present embodiment, the internal rectangular coils 9 are arranged as they are in the voice coil assembly 10 of the preceding embodiment. Specifically, the two internal rectangular coils 9*a* and 9*b* fixed to the inner wall surfaces 31*b* of two adjacent rectangular spaces 31*a* neighboring each other with a partition wall therebetween are arranged so that a direction of audio signal current flow along one side of the internal rectangular coil 9*a* that is neighboring the partition wall is the same as that along one side of the internal rectangular coil 9*b* that is neighboring the partition wall. Thus, the 14 internal rectangular coils 9 are connected together so that driving forces of the same direction act upon the voice coil assembly 30.

Since the lattice-shaped bobbin 31 is an integral structure of a liquid crystal polymer resin, which has desirable rigidity and heat resistance, it is possible to further improve the rigidity as compared with a case where the rectangular bobbins 12 are connected together as shown in the preceding embodiment. Therefore, with the voice coil assembly 30 using the lattice-shaped bobbin 31, it is possible to suppress divided vibrations of the loudspeaker vibrating member 5 including the voice coil assembly 30 and the flat diaphragm 6. Moreover, the lattice-shaped bobbin 31 can be produced with desirable shape/dimension precision, whereby it is possible to realize the loudspeaker 1 with stable sound reproduction.

The material of the lattice-shaped bobbin 31 is not limited to a liquid crystal polymer, but may be a resin material such as polyimide or polyetherimide, and the formation method therefor is not limited to an injection molding as described above, but may alternatively be an extrusion molding. Moreover, the material of the lattice-shaped bobbin 31 may be a paper material. Alternatively, the lattice-shaped bobbin 31 may be obtained by impact-molding a metal material containing aluminum or titanium.

While the flat thin loudspeaker 1 of the present invention uses the magnetic circuit 2 with the 14 main magnets 22, the configuration of the magnetic circuit 2 is not limited to this. The number of magnets used in the magnetic circuit 2 may be fewer than or more than 14, and the arrangement thereof is not limited to a single-row arrangement. For example, a matrix pattern of two or more rows and two or more columns may be employed.

Embodiment 3

FIGS. 5A and 5B are views illustrating a magnetic circuit 20 used in the loudspeaker 1 according to another preferred embodiment of the present invention. FIG. 5A is a perspective view illustrating a magnetic circuit module 2*m* of the magnetic circuit 20, and FIG. 5B is a perspective view illustrating the magnetic circuit 20. The magnetic circuit 2 illustrated in FIGS. 5A and 5B includes six magnetic circuit modules 2*m* connected together. Specifically, the magnetic circuit 20 of FIGS. 5A and 5B includes three magnetic circuit modules 2*a* and three magnetic circuit modules 2*b* (whose direction of magnetization is opposite to that of the magnetic circuit module 2*a*) alternating with each other along a single row so that adjacent magnets have different polarities.

Each magnetic circuit module 2*m* includes a generally rectangular flat plate 23, the main magnet 22 fixed to the bottom surface of the plate 23, the yoke 21 fixed to the bottom surface of the main magnet 22, and the repulsive magnet 24 fixed to the upper surface of the plate 23. The plate 23 and the yoke 21 are formed by a magnetic material such as a soft iron or Permalloy. The main magnet 22 and the repulsive magnet 24 are formed by a magnet material including a rare earth metal such as neodymium. The plate 23, the main magnet 22, the yoke 21 and the repulsive magnet 24 are fixed together by an adhesive. The yoke 21 includes the plate portion 21*a* to which the main magnet 22 is connected, and the side wall portion 21*b* forming a generally straight magnetic gap Ga between the side wall portion 21*b* and one side of the generally rectangular plate 23. In the present embodiment, the magnetic gap Ga is formed along two sides of the generally rectangular shape, corresponding to two parallel side wall portions 21*b*. The main magnet 22 and the repulsive magnet 24 are arranged so that their surfaces of the same magnetic polarity are facing each other with the plate 23 being interposed therebetween, thereby forming a repulsive magnetic field of a high magnetic flux density in the magnetic gap Ga.

The yoke 21 of the magnetic circuit module 2*m* has a generally U-shaped cross section, with opposite end surfaces of the generally U-shaped structure forming a connecting portion 21*c* that is connected to the yoke of an adjacent magnetic circuit module 2*m*, and also forming open holes of the magnetic circuit 20 obtained by connecting the magnetic circuit modules 2*m* together. In other words, the connecting portion 21*c* is a portion where the yoke 21 of the magnetic circuit module 2*m* adheres and connects to the yoke 21 of another magnetic circuit module 2*m*, and functions as a portion where lines of magnetic force of the magnetic circuit 20 pass through. The connecting portions 21*c* are fixed together by an adhesive to thereby form the mechanical connection between magnetic circuit modules.

As the connecting portions 21*c* of the magnetic circuit modules 2*m* are fixed together, the plates 23 of the magnetic circuit modules 2*a* and 2*b* from generally straight magnetic gaps Gb, which are communicated to and perpendicular to the magnetic gap Ga. Since the magnetic circuit modules 2*a* and 2*b* are magnetized in opposite directions, a magnetic field exhibiting a high magnetic flux density is also formed in the magnetic gaps Gb therebetween. In FIGS. 5A and 5B, six magnetic circuit modules 2 are connected together in a row, and the magnetic gaps Ga of the magnetic circuit modules 2*a* and those of the magnetic circuit modules 2*b* are arranged in a straight line, whereby the magnetic circuit 20 as a whole will have a lattice-shaped (or ladder-shaped) magnetic gap including the magnetic gaps Ga and the magnetic gaps Gb. Since the yoke 21 has a generally U-shaped cross section, the magnetic circuit 20 obtained by connecting yokes 21 together defines open holes 20*x* at opposite ends thereof.

Figure 6:
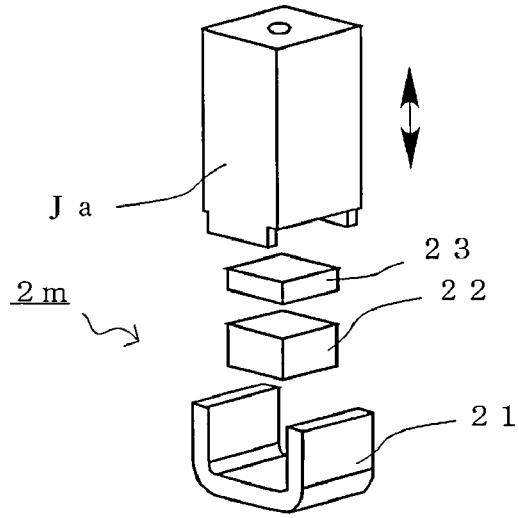
FIGS. 6A and 6B are views illustrating a method for producing a loudspeaker magnetic circuit.
Figure 6:
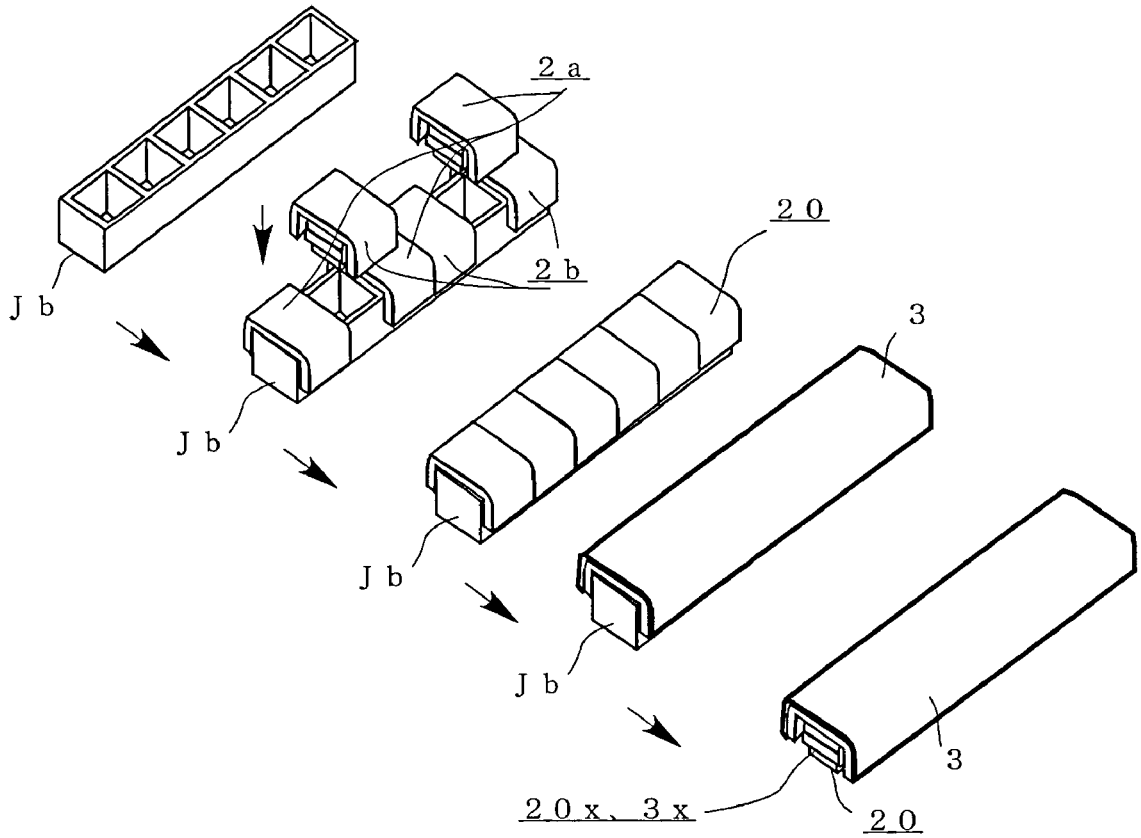

FIGS. 6A and 6B are views illustrating a method for producing a loudspeaker magnetic circuit 20 of the present embodiment. FIG. 6A is a perspective view illustrating a step of producing the magnetic circuit module 2*m*, and FIG. 6B is a perspective view illustrating a step of producing the magnetic circuit 20. Each of the magnetic circuit modules 2*m* is produced by using an assembly jig Ja for defining the magnetic gap Ga, and the magnetic circuit 20 including the magnetic circuit modules 2*m* is produced by using an assembly jig Jb.

As shown in FIG. 6A, the assembly jig Ja is fit into the gap between the plate 23 and the side wall portion 21*b* of the yoke 21, thus defining the magnetic gap Ga. The assembly jig Ja is a tubular member having a generally rectangular cross section so as to surround the periphery of the plate 23, and has a space therein capable of accommodating the plate 23 and the main magnet 22. The assembly jig Ja also has projecting portions for engaging with the connecting portion 21*c* of the yoke 21. Therefore, as the assembly jig Ja is fit into the yoke 21 after an adhesive is applied to the plate 23 and the unmagnetized main magnet 22, the positional relationship between the plate 23 and the yoke 21, which defines the magnetic gap Ga and the magnetic gap Gb, is fixed uniquely. As the assembly jig Ja is removed after the adhesive cures, there is obtained a magnetic circuit module 2*m* that has the magnetic gap Ga and that is not magnetized.

Then, the unmagnetized magnetic circuit modules 2*m* are magnetized so as to obtain the magnetic circuit modules 2*a* exhibiting one magnetic polarity on the side of the plate 23, and the magnetic circuit modules 2*b* exhibiting the opposite magnetic polarity. As described above, the only difference between the magnetic circuit modules 2*a* and 2*b* is that they are magnetized in the magnetization step in opposite directions, and the magnetic circuit modules 2*a* and 2*b* can easily be distinguished from each other by means of marking. Then, the previously-magnetized repulsive magnets 24 are fixed to the upper surfaces of the plates 23 of the magnetic circuit modules 2*a* and 2*b*. As described above, the repulsive magnets 24 are fixed while confirming the orientations thereof so as to appropriately form repulsive magnetic fields.

As shown in FIG. 6B, the magnetic circuit 2 is produced by connecting together the magnetic circuit modules 2*a* and 2*b* by using the assembly jig Jb. The assembly jig Jb is a lattice-shaped jig having such dimensions that the connecting portions 21*c* of the yokes 21 of the six magnetic circuit modules 2*a* and 2*b* fit therein adhere to each other, wherein the lattice-shaped wall portion partitioning magnetic circuit modules from each other defines the magnetic gap Gb formed between the plates 23. If an adhesive is applied to the connecting portions 21*c* before the magnetic circuit modules 2*a* and 2*b* which are previously magnetized in opposite directions and thus have different magnetic polarities are fit into the assembly jig Jb so that the different magnetic polarities alternate with each other, the connecting portions 21*c* of the yokes 21 of different magnetic polarities are fixed together, and the assembly jig Jb can be removed after the adhesive cures, thereby obtaining the magnetic circuit 2.

The magnetic circuit 20 shown in FIG. 6B further includes a holding frame 3 that fits the yokes 21. The holding frame 3 is a member having a generally U-shaped cross section shaped so as to cover all the magnetic circuit modules 2*m* from the back surface side of the magnetic circuit 20, and is fixed to the yokes 21 by an adhesive. The holding frame 3 may be of a magnetic material such as iron as shown in the illustrated example, or a non-magnetic material such as aluminum or a resin. The holding frame 3, which fits all the yokes 21, reinforces the connection between the connecting portions 21*c* and strongly connects the magnetic circuit modules 2*a* and 2*b* together, whereby it is possible to realize the loudspeaker magnetic circuit 20 with reduced operation defects. The assembly jig Jb may be removed before the fixing of the holding frame 3, but is preferably removed after fixing the holding frame 3 as shown in FIG. 6B. The holding frame 3 may be formed integrally with the frame 4 as described above, and since the holding frame 3 has a generally U-shaped cross section, the holding frame 3 defines frame holes 3*x* communicated to the open holes 20*x* of the magnetic circuit 20.

The loudspeaker magnetic circuit 20 of the present invention formed by a plurality of magnetic circuit modules 2*m* is capable of forming a repulsive magnetic field with a high magnetic flux density both in the magnetic gap Ga and in the magnetic gap Gb. As compared even with an undivided, single-unit yoke, the magnetic flux density is not significantly reduced in the magnetic gaps Ga and Gb as long as the connecting portions 21*c* of the yokes 21 are adhered and bonded together by the use of the assembly jig Jb.

The step of providing the magnetic circuit modules 2*a* and 2*b* magnetized in different magnetization directions is basically the same as the step of magnetizing the magnetic circuit for use in an ordinary loudspeaker, whereby the existing loudspeaker production facilities can be used as they are. Thus, even with the loudspeaker magnetic circuit 2 including a plurality of magnets, the production efficiency is high and the production cost can be reduced. Moreover, by providing the magnetic circuit modules 2*a* and 2*b* as repulsive-type magnetic circuits, it is no longer necessary to handle small, magnetized main magnets during the assembly of the loudspeaker magnetic circuit 2, thereby significantly improving the production efficiency.

For example, if a larger magnetic circuit is desired, the number of magnetic circuit modules 2*m* of the magnetic circuit may be increased to 8, 10, 14, . . . , while providing the assembly jig Jb corresponding to the number of magnetic circuit modules. Therefore, the present invention can accommodate various design changes. Thus, it is possible to easily obtain the loudspeaker magnetic circuit 20 having a high magnetic efficiency.

Embodiment 4

Figure 7:
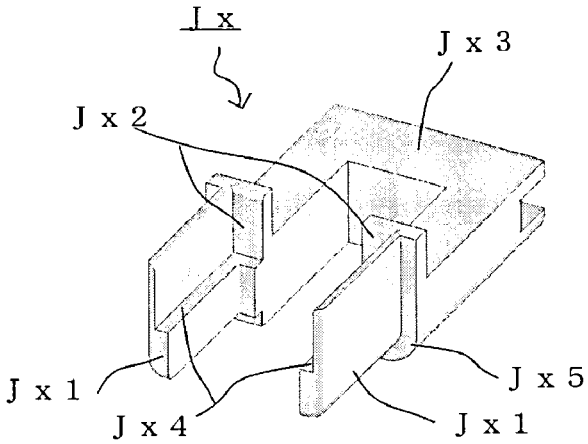
FIGS. 7A and 7B are views illustrating a step in the production of a loudspeaker.
Figure 7:
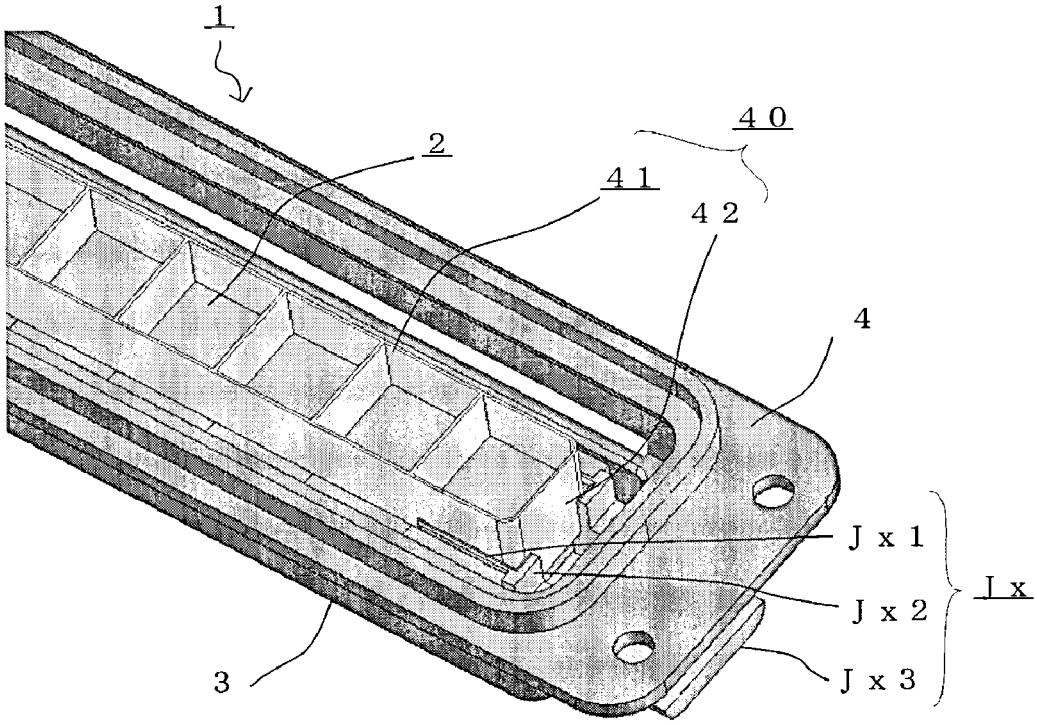
Figure 8:
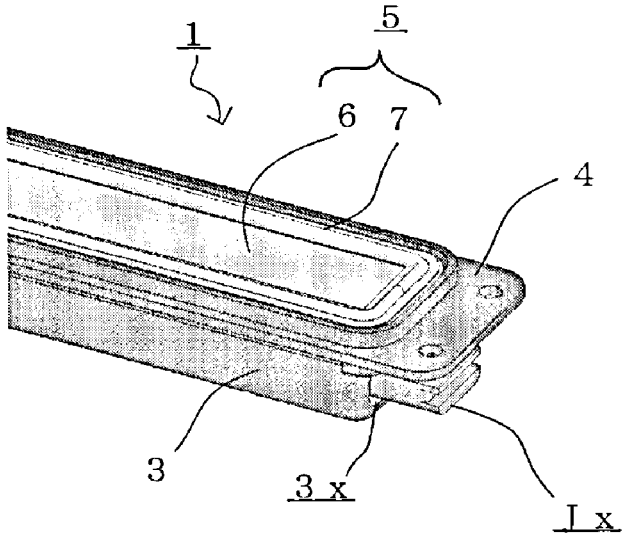
FIGS. 8A and 8B are views illustrating a step in the production of a loudspeaker.
Figure 8:
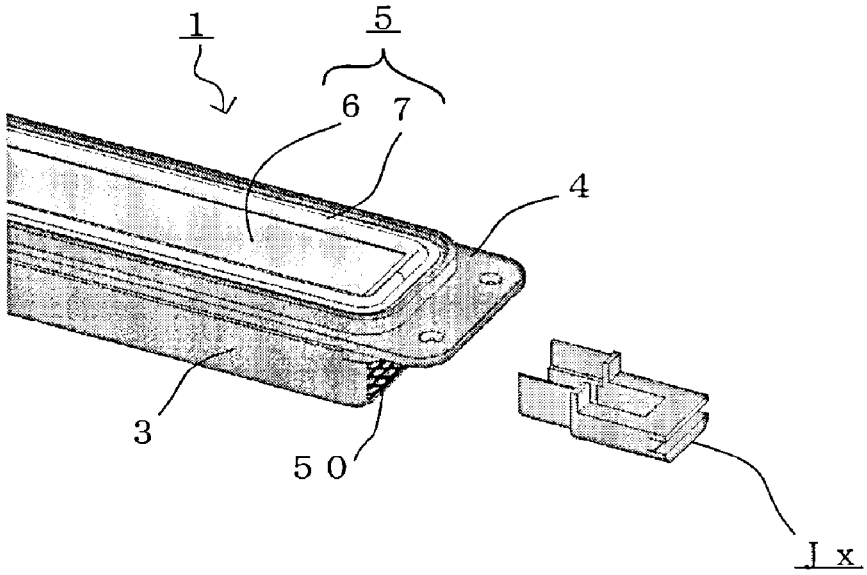

FIGS. 7A, 7B, 8A and 8B are views illustrating steps of producing the loudspeaker 1 of the present embodiment. Specifically, FIG. 7A is a perspective view illustrating an assembly jig Jx for producing a loudspeaker while holding the voice coil assembly, and FIG. 7B is a enlarged perspective view illustrating the loudspeaker 1 with the assembly jig Jx inserted therein, wherein the loudspeaker vibrating member 5 including the flat diaphragm 6, etc., are not shown in some of the figures. FIG. 8A is an enlarged perspective view illustrating the loudspeaker 1 with the assembly jig Jx inserted therein, and FIG. 8B is an enlarged perspective view illustrating the loudspeaker 1 with the assembly jig Jx having been removed. FIGS. 7B, 8A and 8B show, on an enlarged scale, only one edge portion of the elongate loudspeaker 1.

As shown in FIG. 7A, the assembly jig Jx is an assembly jig for a loudspeaker vibrating system made of a resin such as POM (polyacetal) or PTFE (polytetrafluoroethylene) or a non-magnetic metal such as a brass, which is inserted from each of open holes 2*x* defined at opposite ends of the magnetic circuit 2 to hold the opposite ends of a voice coil assembly 40 during the production of the loudspeaker 1. The assembly jig Jx includes two straight holding sections Jx1 to be inserted between an outer wall surface 42 of the voice coil assembly 40 and the side wall portion 21*b* of the yoke 21 defining the magnetic gap Ga of the magnetic circuit 2, an end surface holding section Jx2 held against the outer wall surfaces 42 exposed at opposite ends of the voice coil assembly 40, and a connecting section Jx3 connecting together the two straight holding sections Jx1 and the end surface holding section Jx2. The cross section of the two straight holding sections Jx1 has a narrow-width portion inserted between the outer wall surface 42 of the voice coil assembly 40 and the side wall portion 21*b* of the yoke 21, and a wide-width portion for receiving a lattice-shaped bobbin 41 of the voice coil assembly 40, with the stepped portion therebetween defining a voice coil receiving portion Jx4 for placing the internal rectangular coil 9 of the voice coil assembly 40 in the magnetic gaps Ga and Gb. A flange portion Jx5 to be held against the open hole 2*x* of the magnetic circuit 2 is formed in the peripheral portion of the end surface holding section Jx2, and the end surface holding section Jx2 of the assembly jig Jx restricts the positions at which the outer wall surfaces 42 at opposite ends of the voice coil assembly 40 are contacted.

As shown in FIGS. 7B and 8A, the assembly jig Jx is inserted from the frame hole 3*x* of the holding frame 3 communicated to the open hole 2*x* of the magnetic circuit 2, and the straight holding section Jx1 and the end surface holding section Jx2 is held against the outer wall surfaces 42 at opposite ends of the voice coil assembly 40. Thus, as the four corners of the voice coil assembly 40 including the elongate, generally-rectangular, lattice-shaped bobbin 41 are restricted by the assembly jig Jx inserted from the open holes 2*x* at opposite ends of the magnetic circuit 2, the internal rectangular coils 9 of the voice coil assembly 40 can be placed in the magnetic gaps Ga and Gb. Therefore, as the assembly jig Jx is removed, the outer wall surfaces at opposite ends of the voice coil assembly 40 of the loudspeaker 1 are exposed through the open holes 2*x* and the frame holes 3*x*. Herein, "the outer wall surfaces at opposite ends of the voice coil assembly 40 being exposed" means that the outer wall surfaces at opposite ends of the voice coil assembly 40 can be seen from outside through the open holes 2*x* and the frame holes 3*x*, whereby the assembly jig Jx can be held against the outer wall surfaces. The voice coil assembly 40 of the loudspeaker 1 of the present embodiment is similar to the voice coil assembly 30 of the preceding embodiment, except for the total number of internal rectangular coils 9, the specific shape of the lattice-shaped bobbin 41, etc.

As shown in FIGS. 8A and 8B, in the step of providing a loudspeaker vibrating system including the loudspeaker vibrating member 5, the adhesive can be allowed to cure with the assembly jig Jx fit in the assembly. The loudspeaker vibrating member 5 includes the flat diaphragm 6, the edge 7 for supporting the outer periphery of the flat diaphragm 6 so as to allow vibrations of the diaphragm 6, and the voice coil assembly 40, to be described later, fixed to the back surface side of the flat diaphragm 6, wherein these components are fixed together by an adhesive. One end of lead wires (not shown) is connected and fixed to an input terminal and an output terminal of a plurality of internal-winding voice coils of the voice coil assembly 40 connected together, with the other end of the lead wires connected and fixed to a terminal (not shown). Moreover, a loudspeaker diaphragm 6 is bonded to the voice coil assembly 40, and the edge 7 for supporting the outer periphery of the loudspeaker diaphragm 6 so as to allow vibrations of the loudspeaker diaphragm 6 is bonded to the frame 4. Therefore, as the assembly jig Jx is removed after the adhesive cures, there is obtained a loudspeaker vibrating system that can vibrate. Thus, the present invention realizes a production method with a reduced number of steps and a stable product quality, and with the loudspeaker 1 of the present embodiment, it is possible to suppress operation defects such as the occurrence of an abnormal noise due to the voice coil assembly 40 including the lattice-shaped bobbin 41 contacting the magnetic circuit 2.

With the loudspeaker 1 of the present embodiment, a dust-proof member 50 for covering the open holes 2*x* and the frame holes 3*x* communicated to the magnetic gaps Ga and Gb may be further provided after removing the assembly jig Jx, in order to prevent foreign substances such as iron powder from entering the magnetic circuit 2. The dust-proof member 50 may be an air-permeable woven or non-woven fabric, or the like, whose peripheral portion is bonded and fixed to the holding frame 3 so as to cover the open holes 2*x* and the frame holes 3*x*. The dust-proof member 50 may be an air-permeable material such as a punching net, and the dust-proof member 50 preferably suppresses the increase in the compliance due to the air inside the magnetic circuit 2 even when the open holes 2*x* and the frame holes 3*x* are covered.

Embodiment 5

Figure 9:
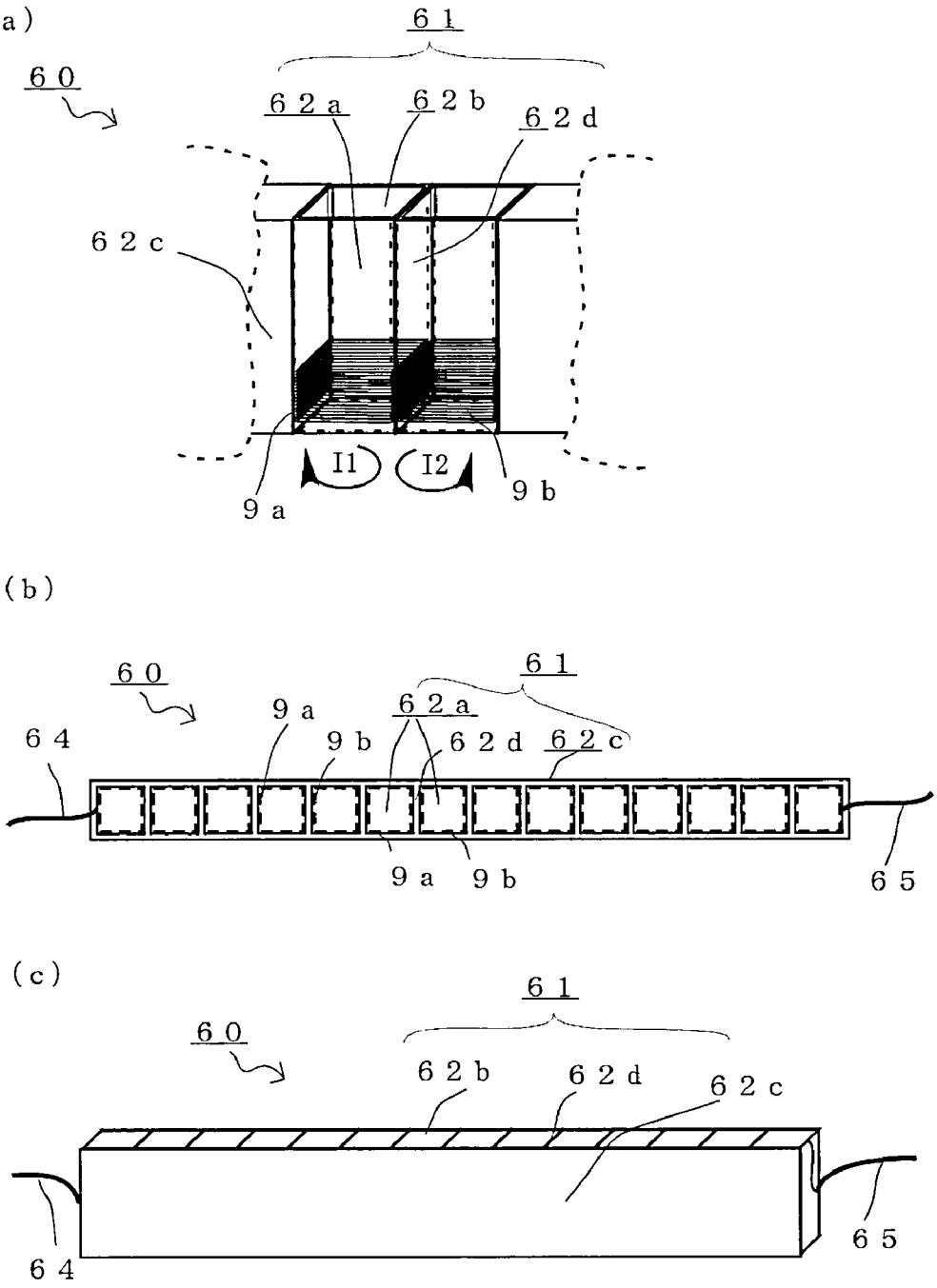
FIGS. 9A to 9C are views illustrating a voice coil assembly of another flat thin loudspeaker.
Figure 10:
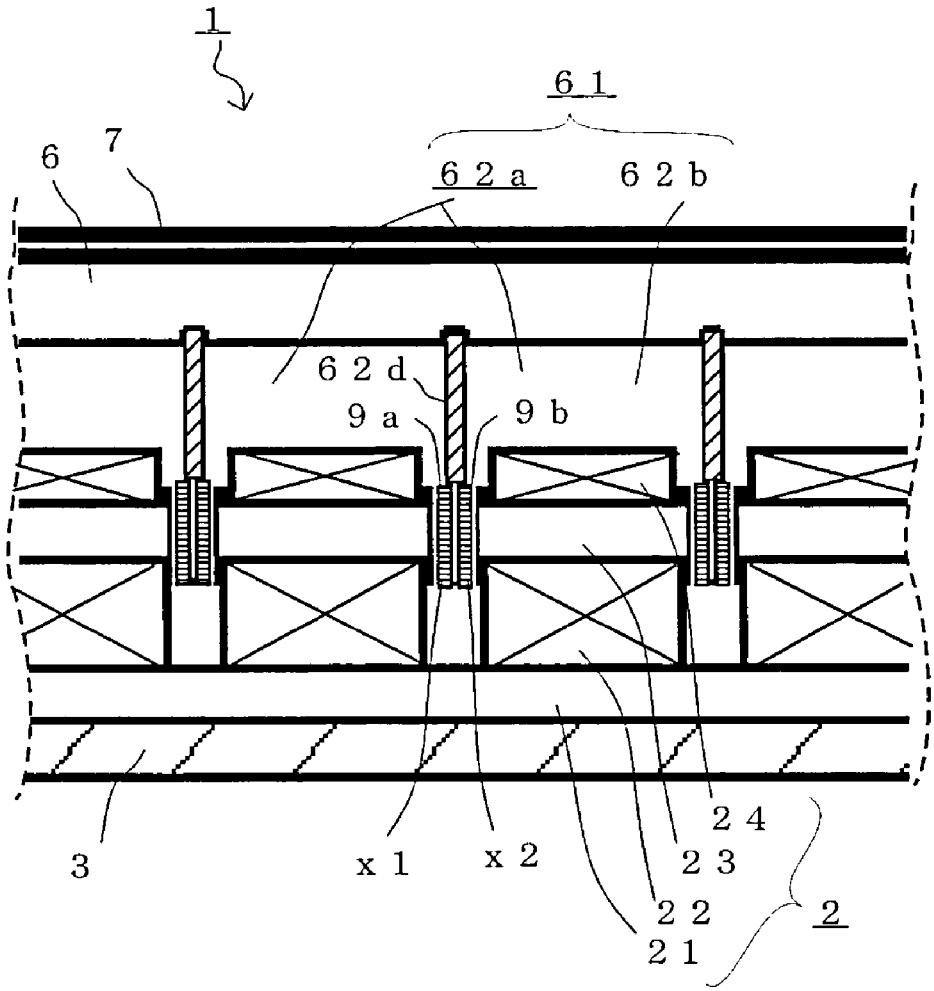
FIG. 10 is an enlarged cross-sectional view illustrating a part of a voice coil assembly of another flat thin loudspeaker.

FIGS. 9A to 9C are views illustrating a voice coil assembly 60 of the flat thin loudspeaker 1 according to another preferred embodiment of the present invention. FIG. 9A is an enlarged cross-sectional view illustrating a portion of the voice coil assembly 60, FIG. 9B is a plan view of the voice coil assembly 60, and FIG. 9C is a perspective view illustrating the entire voice coil assembly 60. FIG. 10 is an enlarged cross-sectional view illustrating a portion of the voice coil assembly 60 fixed to the back surface side of the flat diaphragm 6 of the flat thin loudspeaker 1. In these figures, some elements are seen through others for the purpose of illustration. The voice coil assembly 60 includes a lattice-shaped bobbin 61 having a lattice-shaped cross section with 14 rectangular spaces 62*a* defined therein, and 14 internal rectangular coils 9 each fixed to an inner wall surface 62*b* defining the rectangular space 62*a*.

The lattice-shaped bobbin 61 is obtained by injection-molding a liquid crystal polymer of a resin material into a lattice-shaped (ladder-shaped) bobbin having an average thickness of 0.2 mm, defining the 14 rectangular spaces 62*a* arranged in a row. The internal rectangular coils 9 are adhered and fixed to the inner wall surfaces 62*b* by an adhesive while being fit in the rectangular spaces 62*a* of the lattice-shaped bobbin 61. Specifically, the inner dimension of the rectangular space 62*a* is about 9.1 mm by about 9.1 mm. In the presence of the inner wall surface 62*b* and partition walls 62*d*, the lattice-shaped bobbin 61 has a rectangular cross section, and therefore the lattice-shaped bobbin 61 includes the rectangular spaces 62*a* therein, and an outer wall surface 62*c* forms four planes. With the lattice-shaped bobbin 61 obtained by molding a resin as in the present embodiment, the inner wall surface 62*b* defining the rectangular space 62*a* can be provided with a stepped portion 62*e* (to be described later) for receiving and stopping the internal rectangular coil 9.

The internal rectangular coil 9 is a rectangular bobbinless winding of a copper wire having a diameter of 0.12 mm whose outer dimension is about 9.1 mm by about 9.1 mm, and the outer dimension of the internal rectangular coil 9 is generally equal to the inner dimension of the rectangular space 62*a* of the lattice-shaped bobbin 61. The thickness tc1 (or tc2) of each side of the internal rectangular coil 9 is about 0.3 mm. The internal rectangular coil 9 is produced as follows. A wire is wound around a tentative rectangular core and then an adhesive or a varnish is applied thereon. After the adhesive or the varnish cures, the core is removed to obtain the bobbinless internal rectangular coil 9. The rectangular shape of the lattice-shaped bobbin 61 and the internal rectangular coil 9 as used herein includes those with rounded corners for preventing the material from breaking due to sharp bending. The rounded corners may be of any curvature as long as they do not interfere with the rectangular plate 23, etc., of the magnetic circuit 2.

Thus, with the voice coil assembly 60 of the present invention, the internal rectangular coils 9 are adhered and fixed to the inner wall surface 62*b* by an adhesive while being fit in the rectangular spaces 62*a* of the lattice-shaped bobbin 61. Two adjacent internal rectangular coils 9 of the lattice-shaped bobbin 61 are arranged so that the direction of the audio signal current flow along one side of one of the adjacent internal rectangular coils 9 that is neighboring the boundary between the two adjacent internal rectangular coils 9 is the same as that along one side of the other one of the adjacent internal rectangular coils 9 that is neighboring the boundary. For example, in the voice coil assembly 60 shown in FIG. 9B, internal rectangular coils 9*a* and 9*b* are arranged so that where there is a clockwise current flow I1 through the internal rectangular coil 9*a* of the lattice-shaped bobbin 61, there is a counter-clockwise current flow I2 through the internal rectangular coil 9*b* of the lattice-shaped bobbin 61. In other words, the internal rectangular coils 9*a* and 9*b* are arranged so that the direction of the audio signal current flow along the right side of the internal rectangular coil 9*a* positioned on the left side is the same as that along the left side of the internal rectangular coil 9*b* positioned on the right side.

Herein, the internal rectangular coils 9*a* and 9*b* are facing each other with the partition wall 62*d* of the inner wall surface 62*b* being interposed therebetween, and are arranged so as to allow an audio signal current to flow in the same direction along the partition wall 62*d*. Therefore, in the flat thin loudspeaker 1 using the voice coil assembly 60, the internal rectangular coils 9*a* and 9*b* are arranged so as to face each other with the partition wall 62*d* being interposed therebetween, between two adjacent rectangular plates 23 in the lattice-shaped magnetic gap of the magnetic circuit 2, as shown in FIG. 10. The internal rectangular coils 9*a* and 9*b* each have an electromagnetic force acting in the upward or downward direction, and the voice coil assembly 60, which has other internal rectangular coils 9 placed in the magnetic gap, receives a driving force in the upward or downward direction, whereby the flat diaphragm 6 can be displaced up or down. As a result, the flat diaphragm 6 vibrates, and the flat thin loudspeaker 1 reproduces a sound.

Thus, in the voice coil assembly 60 of the present embodiment, the internal rectangular coils 9 are fixed to the inner wall surfaces 62*b* of the 14 rectangular spaces 62*a*. For example, as shown in FIGS. 9A to 9C, two internal rectangular coils 9*a* and 9*b* are arranged with the partition wall 62*d* being interposed therebetween so that the direction of the audio signal current flow along one side of one of the adjacent internal rectangular coils that is neighboring the partition wall 62*d* is the same as that along one side of the other one of the adjacent internal rectangular coils 9 that is neighboring the partition wall 62*d*. As shown in FIGS. 9A to 9C and 10, the two internal rectangular coils 9*a* and 9*b* are fixed to two adjacent rectangular spaces 62*a*, respectively, facing each other with the partition wall 62*d* of the inner wall surface 62*b* being interposed therebetween. The arrangement is such that the audio signal currents I1 and I2 flow in the same direction along one side x1 of one internal rectangular coil 9*a* that is neighboring the partition wall 62*d* and along one side x2 of another internal rectangular coil 9*b* that is neighboring the partition wall 62*d*. The 14 internal rectangular coils 9 are connected together in this manner so that the voice coil assembly 60 receives driving forces in the same direction.

The connection of the internal rectangular coils 9 can be either a serial connection or a parallel connection. A serial connection and a parallel connection may be both used, taking into consideration the impedance of each internal rectangular coil 9 and the overall impedance of the entire structure. In order for adjacent coils to conduct audio signal current flows of the opposite rotational directions, two types of coils of different winding directions may be used for the internal rectangular coils 9, or the internal rectangular coils 9 of the same winding direction may be connected together while alternating the start and end of winding.

Figure 11:
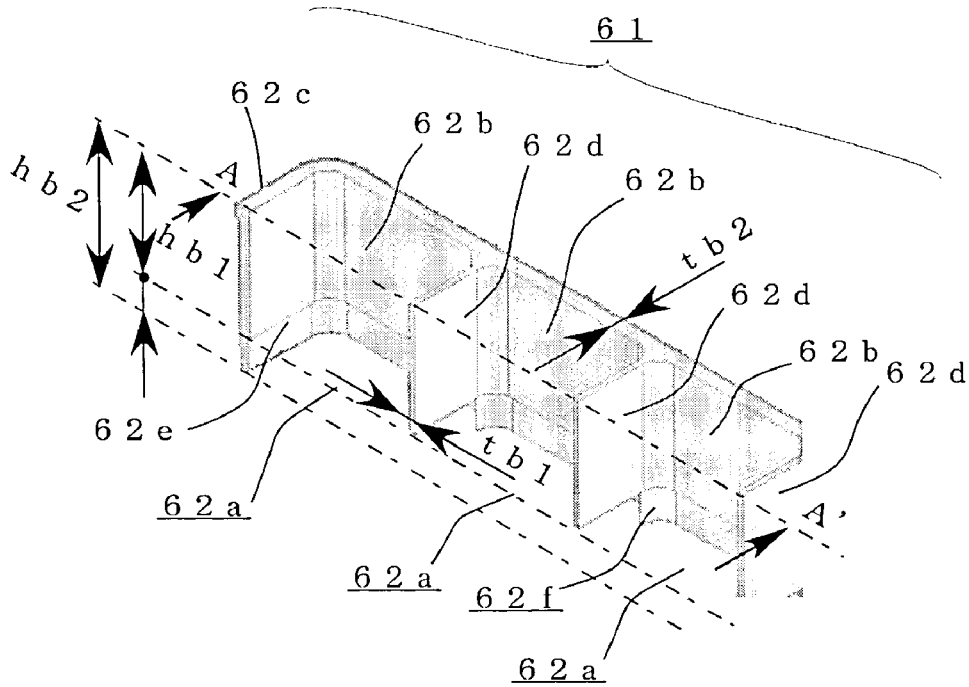
FIGS. 11A and 11B are views illustrating a voice coil assembly of another flat thin loudspeaker.
Figure 11:
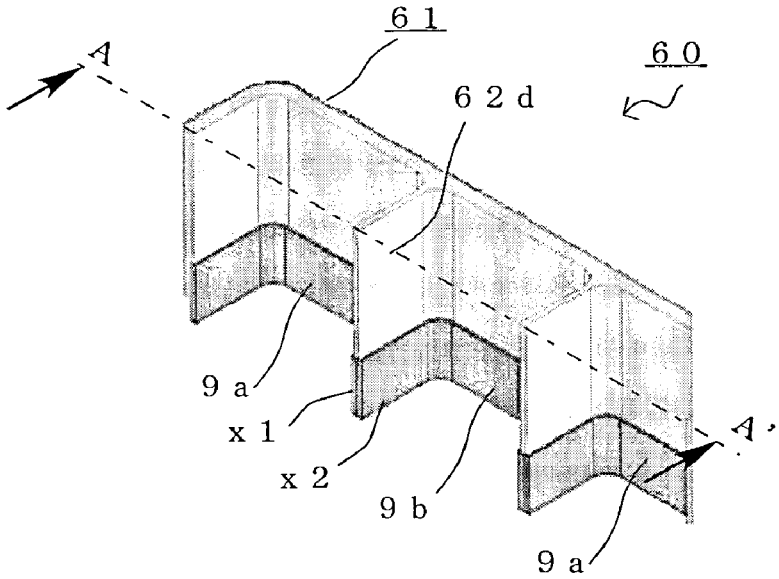

FIGS. 11A and 11B are enlarged cross-sectional views illustrating a portion of the voice coil assembly 60 of the present embodiment, including three rectangular spaces 62*a* from one end of the lattice-shaped bobbin 61 in the major-axis direction. Specifically, FIG. 11A is a cutaway perspective view of the lattice-shaped bobbin 61 along the center line A-A' indicating the major-axis direction of the voice coil assembly 60, and FIG. 11B is a cutaway perspective view of the voice coil assembly 60 taken along the same line.

The lattice-shaped bobbin 61 is an integral structure of a liquid crystal polymer resin, which has desirable rigidity and heat resistance, and the generally rectangular outline portion forming the inner wall surface 62*b* and the outer wall surface 62*c* has an average thickness tb2 of 0.3 mm, as shown in FIG. 11A. The height hb2 of the outline portion is about 8.9 mm. On the side of the inner wall surface 62*b*, the outline portion of the lattice-shaped bobbin 61 includes the stepped portion 62*e* for receiving and stopping the internal rectangular coil 9, and the stepped portion 62*e* is formed by partially thinning the inside of the outline portion. While the lattice-shaped bobbin 61 shown in FIG. 11A includes stepped corner portion 62*f* engaging the outer side of the four corners of the internal rectangular coils 9, the stepped corner portions 62*f* may be omitted so that the part tolerance and the assembly tolerance along the center line A-A' indicating the major-axis direction can be accommodated. The lattice-shaped bobbin 61 without the stepped corner portions 62*f* also has an advantage that it can be more easily molded from a resin.

The partition wall 62*d*, defining the rectangular space 62*a* together with the inner wall surface 62*b*, has an average thickness tb1 of 0.2 mm, which is smaller than the thickness tb2 of the outline portion. The height hb1 of the partition wall 62*d* is about 6.1 mm, smaller than the height hb2 of the outline portion of the lattice-shaped bobbin 61. As a result, the height of the lower end of the partition wall 62*d* and that of the stepped portion 62*e* coincide with each other, whereby the internal rectangular coil 9 can be received and stopped. Thus, the internal rectangular coils 9 are inserted from the lower side into the rectangular spaces 62*a* of the lattice-shaped bobbin 61, and are engaged with and attached to the lower end of the partition wall 62*d* and the stepped portion 62*e*.

As shown in FIG. 11B, the internal rectangular coils 9*a* and 9*b* are attached respectively to two adjacent rectangular spaces 62*a*. As described above, the internal rectangular coils 9*a* and 9*b* are arranged so that audio signal currents flow in the same direction along one side x1 of one internal rectangular coil 9*a* that is neighboring the partition wall 62*d* and along one side x2 of another internal rectangular coil 9*b* that is neighboring the partition wall 62*d*. Since the height hb1 of the partition wall 62*d* is shorter than the height hb2 of the outline portion of the lattice-shaped bobbin 61, the side x1 of the internal rectangular coil 9*a* of the lattice-shaped bobbin 61 and the side x2 of the internal rectangular coil 9*b* are substantially in contact with each other with the partition wall 62*d* being not interposed therebetween.

In other words, the partition wall 62*d* of the lattice-shaped bobbin 61 is omitted between the sides x1 and x2 of the two internal rectangular coils 9*a* and 9*b* that are neighboring the partition wall 62*d*, whereby it is possible to reduce the total weight of the lattice-shaped bobbin 61. Since the lattice-shaped bobbin 61 of the present embodiment includes as many as 13 partition walls 62*d* defining 14 rectangular spaces 62*a*, it is effective, in realizing a light weight, to reduce the thickness of each partition wall 62*d*. While the weight of the lattice-shaped bobbin 61 is about 2.7 g in the present embodiment, that of a comparative example is about 2.1 g where the lattice-shaped bobbin is entirely formed with an average thickness of 0.3 mm (i.e., where the thickness of the partition wall 62*d* is not reduced to the thickness tb1, and the height of the partition wall 62*d* is not reduced below the height hb2). Thus, the weight of the lattice-shaped bobbin 61 can be reduced by as much as about 20% or more.

Figure 12:
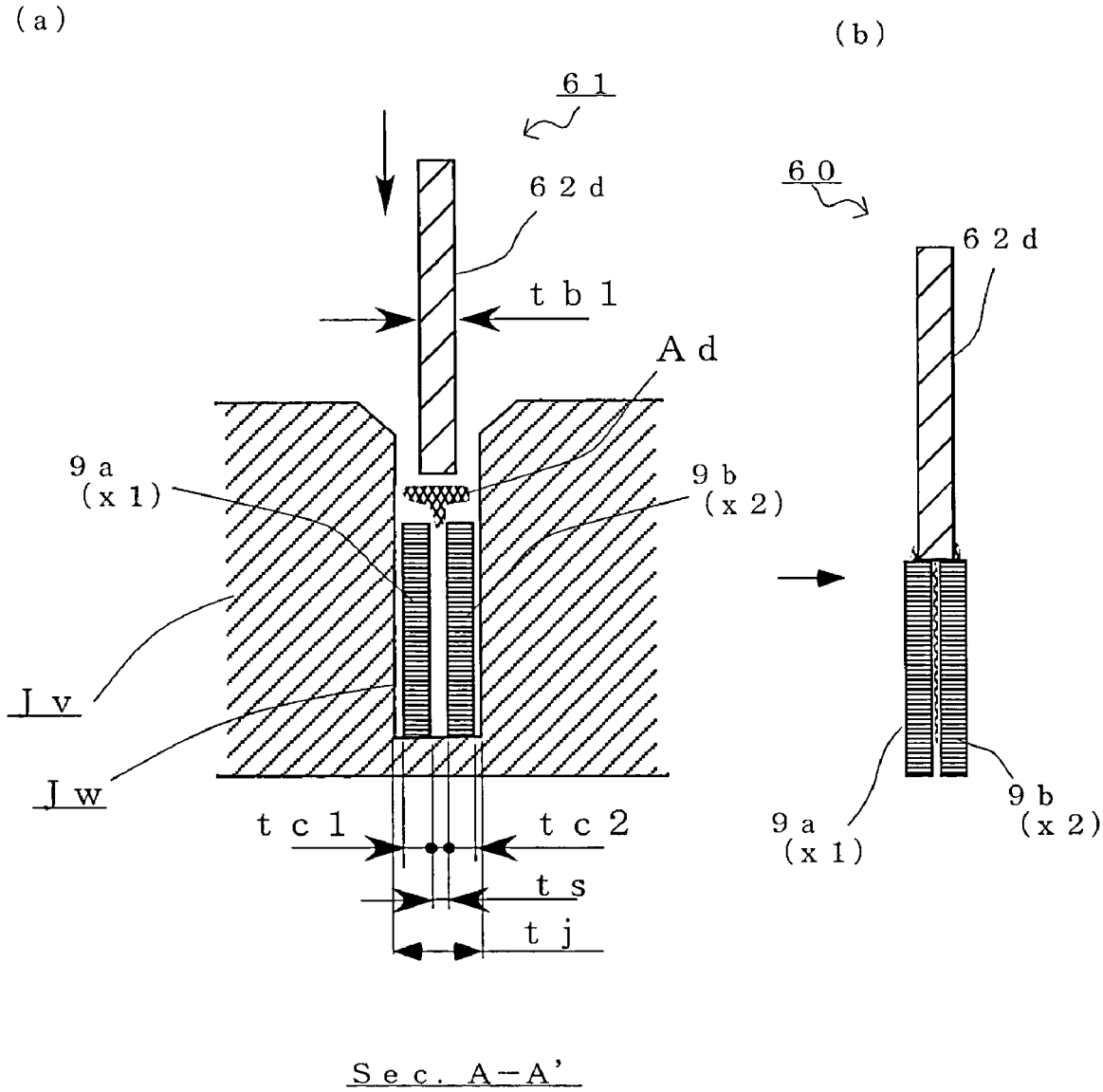
FIGS. 12A and 12B are views illustrating another voice coil assembly and a production step thereof.

FIGS. 12A and 12B are views illustrating the voice coil assembly 60 and a production step thereof. Specifically, FIGS. 12A and 12B are enlarged cross-sectional views, taken along the center line A-A' indicating the major-axis direction, partially showing the partition wall 62*d* of the lattice-shaped bobbin 61 and the internal rectangular coils 9*a* and 9*b*. FIG. 12A is a view illustrating the step of bonding the partition wall 62*d* of the lattice-shaped bobbin 61 with the sides x1 and x2 of the internal rectangular coils 9*a* and 9*b* by means of an adhesive Ad and an bonding jig Jv, and FIG. 12B is a view illustrating the voice coil assembly 60 with the bonding jig Jv having been removed after the adhesive Ad cures. The lattice-shaped bobbin 61 including the partition walls 62*d* and the internal rectangular coils 9 are provided in advance in separate steps.

The bonding jig Jv includes a base body formed by a material such as Duracon or a fluorocarbon resin, for example, and a predetermined lattice-shaped groove Jw in conformity to the shape of the lattice-shaped bobbin 61. Since the bonding jig Jv is used in the step of applying the adhesive Ad such as an epoxy adhesive or an acrylic adhesive, for example, by using a microdispenser, it is preferred that the bonding jig Jv is coated with a fluorocarbon resin, for example, so that the adhesive Ad left cured on the lattice-shaped groove Jw can be easily removed. In the present embodiment, the width tj of the lattice-shaped groove Jw shown in FIG. 12A is about 0.7 mm, greater than the thickness tb1 (=about 0.2 mm) of the partition wall 62*d* of the lattice-shaped bobbin 61 to be inserted. Moreover, in view of the part tolerance and the assembly tolerance in the major-axis direction, the width tj is set to be greater than the total thickness tc0 (=about 0.6 mm) being the sum of the thickness tc1 (=about 0.3 mm) of one side x1 of the internal rectangular coil 9*a* and the thickness tc2 (=about 0.3 mm) of one side x2 of the internal rectangular coil 9*b*.

Thus, the internal rectangular coils 9*a* and 9*b* are fit into the lattice-shaped groove Jw of the bonding jig Jv, the adhesive Ad is applied to the upper end surface of the internal rectangular coils 9*a* and 9*b*, and then the lattice-shaped bobbin 61 is fit into the lattice-shaped groove Jw of the bonding jig Jv, thereby fixing the internal rectangular coils 9*a* and 9*b* to the inner wall surfaces 62*b* defining the rectangular spaces 62*a* of the lattice-shaped bobbin 61. When fit into the lattice-shaped groove Jw of the bonding jig Jv, the internal rectangular coil 9 is fixed to a predetermined size and shape, with the interval between two internal rectangular coils being uniform. Since the outer diameter tolerance of the internal rectangular coil 9 is ±0.05 mm, the distance ts between the internal rectangular coils 9*a* and 9*b* is 0.1 mm at maximum. Although the distance between the side x1 of the internal rectangular coil 9*a* and the side x2 of the internal rectangular coil 9*b* is exaggerated in the schematic figures, the actual tolerance is very small, so that the gap is filled with the adhesive Ad and the side x1 of the internal rectangular coil 9*a* and the side x2 of the internal rectangular coil 9*b* are substantially in contact with each other with the partition wall 62*d* being not interposed therebetween.

The adhesive Ad bonds the upper end surface of the internal rectangular coils 9*a* and 9*b* with the lower end surface of the partition wall 62*d* of the lattice-shaped bobbin 61. The adhesive Ad is preferably an epoxy adhesive or an acrylic adhesive, and is applied by means of a microdispenser. For example, the microdispenser has a very thin needle valve, is capable of adjusting the minimum application dose by 0.001 cc or more, and is capable of application at a predetermined position with a resolution of 0.005 mm in the horizontal X-Y direction by the use of a 4-axis applicator robot. With a ceramics microdispenser nozzle, a microdispenser is capable of applying the adhesive Ad at a predetermined position with a minimum inner diameter of 0.005 mm. In the present embodiment, the microdispenser is adjusted so that the application dose is about 0.5 mg/mm, and the internal rectangular coils 9 are bonded to the lattice-shaped bobbin 61.

As shown in FIGS. 12A and 12B, if the thickness tb1 of the partition wall 62*d* of the lattice-shaped bobbin 61 is less than or equal to the sum tc0 of two sides of the internal rectangular coil 9, the side x1 of the internal rectangular coil 9*a* and the side x2 of the internal rectangular coil 9*b* can be placed closest to each other in each magnetic gap in the magnetic circuit 2. Specifically, as shown in FIG. 12B, the sides x1 and x2 of the two internal rectangular coils 9*a* and 9*b* along the partition wall 62*d* are fixed together by the adhesive Ad with the partition wall 62*d* being not interposed therebetween, with the upper end surface of the sides x1 and x2 being fixed to the lower end surface of the partition wall 62*d* by the adhesive Ad. Therefore, all the internal rectangular coils 9, including the internal rectangular coils 9*a* and 9*b*, are connected together, and the lead wires 14 and 15 are connected to the input terminal and the output terminal of the obtained structure. Then, after the adhesive Ad cures, the voice coil assembly 60 is removed from the lattice-shaped groove Jw of the bonding jig Jv, thus obtaining the voice coil assembly 60.

Since the partition wall 62*d* is not interposed between the side x1 of the internal rectangular coil 9*a* and the side x2 of the internal rectangular coil 9*b*, it is possible to further narrow the magnetic gap in the magnetic circuit 2 of the loudspeaker 1 using the voice coil assembly 60. Specifically, while the width of the magnetic gap in the magnetic circuit 2 is about 1.4 mm or more in the comparative example described above, it is as small as about 1.2 mm in the present embodiment. In the loudspeaker 1 using the voice coil assembly 60 of the present embodiment, there is substantially no possibility that the partition wall 62*d* of the lattice-shaped bobbin 61 contacts the two rectangular plates 23 forming the magnetic gap. As a result, it is possible to realize a flat thin loudspeaker having a high efficiency with reduced gap defects. The lattice-shaped bobbin 61 is an integral structure of a liquid crystal polymer resin, which has desirable rigidity and heat resistance, and the internal rectangular coils 9 are connected with each other, thus improving the rigidity. Therefore, with the voice coil assembly 60 using the lattice-shaped bobbin 61, it is possible to suppress divided vibrations of the loudspeaker vibrating member 5 including the voice coil assembly 60 and the flat diaphragm 6.

Moreover, the lattice-shaped bobbin 61 can be produced with desirable shape/dimension precision, whereby it is possible to realize the loudspeaker 1 with stable sound reproduction. The material of the lattice-shaped bobbin 61 is not limited to a liquid crystal polymer, but may be a resin material such as polyimide or polyetherimide, and the formation method therefor is not limited to an injection molding as described above, but may alternatively be an extrusion molding. Alternatively, the lattice-shaped bobbin 61 may be obtained by impact-molding a metal material containing aluminum or titanium.

While the 14 main magnets 22 axnd the 14 internal rectangular coils 9 are all rectangular in the flat thin loudspeaker 1 of the present embodiment, the number of magnets and coils may be any number greater than or equal to two, and the shape of these elements may be either a square or an oblong rectangle.

Embodiment 6

Figure 13:
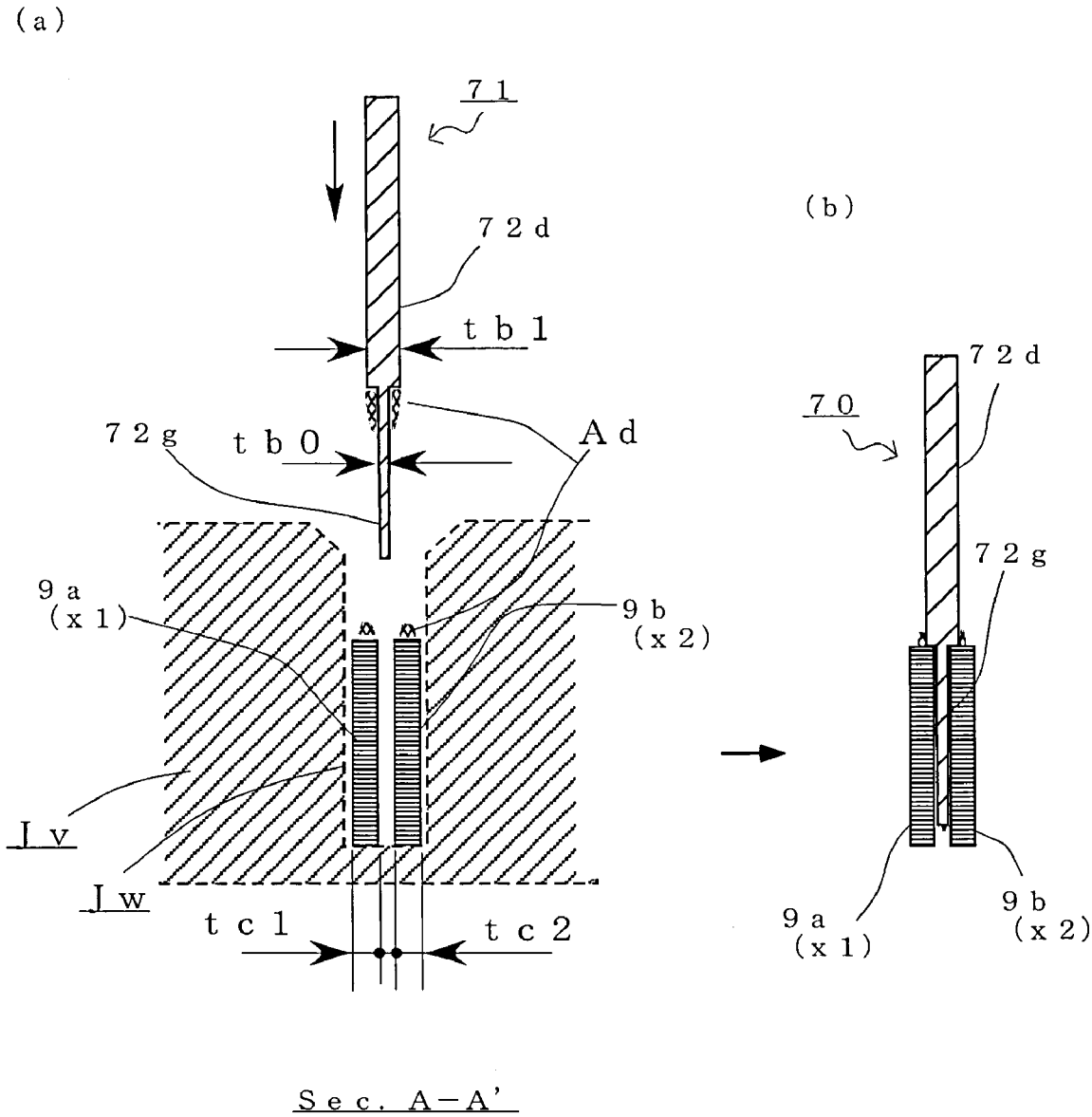
FIGS. 13A and 13B are views illustrating another voice coil assembly and a production step thereof.

FIGS. 13A and 13B are views, similar to FIGS. 12A and 12B of the preceding embodiment, illustrating another voice coil assembly 70 and a production step thereof. Specifically, FIGS. 13A and 13B are enlarged cross-sectional views, taken along the center line A-A' indicating the major-axis direction, partially showing a partition wall 72*d* of a lattice-shaped bobbin 71 and the internal rectangular coils 9*a* and 9*b*. FIG. 13A is a view illustrating the step of bonding the partition wall 72*d* and a partition wall extension 72*g* of the lattice-shaped bobbin 71 with the sides x1 and x2 of the internal rectangular coils 9*a* and 9*b* by means of the adhesive Ad and the bonding jig Jv, and FIG. 13B is a view illustrating the voice coil assembly 70 with the bonding jig Jv having been removed after the adhesive Ad cures.

The lattice-shaped bobbin 71 of the present embodiment made of a liquid crystal polymer is substantially the same as that of the preceding embodiment in terms of the dimensions and the weight, except for the provision of the partition wall extension 72*g* extending from the partition wall 72*d*. Therefore, like elements to those of the preceding embodiment will be denoted by like reference numerals and will not be further described below. A voice coil assembly using the lattice-shaped bobbin of the present embodiment may replace the voice coil assembly of the preceding embodiment to provide the flat thin loudspeaker 1.

The partition wall extension 72*g* is a portion being thinner than the partition wall 72*d* and extending from the lower end of the partition wall 72*d* between the sides x1 and x2 of the two internal rectangular coils 9*a* and 9*b* along the partition wall 72*d*. In other words, the internal rectangular coils 9*a* and 9*b* are facing each other with the partition wall extension 72*g* being interposed therebetween. Specifically, the thickness tb0 of the partition wall extension 72*g* is about 0.1 mm, being smaller than the thickness tb1 (=about 0.2 mm) of the partition wall 72*d*. Thus, the thickness-transition portion between the partition wall 72*d* and the partition wall extension 72*g* defines a stepped portion 72*e* and a stepped corner portion 72*f* as in the preceding embodiment. The weight of the lattice-shaped bobbin 71 of the present embodiment is greater than that of the preceding embodiment by about 0.2 g, but is still lighter than the comparative example. With the voice coil assembly 70 using the lattice-shaped bobbin 71, it is possible to realize the loudspeaker 1 with a high efficiency.

As shown in FIG. 13A, the lattice-shaped bobbin 71 of the present embodiment can be obtained by fitting a member molded in advance to include the partition wall extension 72*g* into the lattice-shaped groove Jw of the bonding jig Jv. Alternatively, in the step of molding the lattice-shaped bobbin 71, a plurality of internal rectangular coils 9 may be placed in a predetermined mold and the lattice-shaped bobbin may be insert-molded so as to provide the partition wall extension 72*g*. Specifically, as with the bonding jig Jv, the side x1 of the internal rectangular coil 9*a* and the side x2 of the internal rectangular coil 9*b* are spaced apart from each other, in an insert mold, by the minimum part distance ts, which is dictated by the part tolerance and the assembly tolerance. Nevertheless, a resin injected in the insert molding process runs into the gap between the sides x1 and x2, thereby connecting together the internal rectangular coils 9*a* and 9*b*. Therefore, the internal rectangular coils 9 can be fixed without using an adhesive in the step of molding the lattice-shaped bobbin 71.

The loudspeaker vibrating member and the production method therefor of the present invention are applicable not only to loudspeakers using flat diaphragms but also to diaphragms for headphones.

What is claimed is:

1. A voice coil assembly, comprising a plurality of internal-winding voice coils, each including a rectangular bobbin having a rectangular cross section and defining a rectangular space therein and an internal rectangular coil fixed to an inner wall surface of the rectangular bobbin defining the rectangular space, wherein an outer wall surface of the rectangular bobbin of one internal-winding voice coil is adhered and fixed to an outer wall surface of the rectangular bobbin of another internal-winding voice coil.

2. The voice coil assembly according to claim 1, wherein two adjacent internal-winding voice coils, of which the outer wall surfaces of the rectangular bobbins are adhered and fixed to each other, are arranged so that a direction of an audio signal current flow along one side of the internal rectangular coil of one of the adjacent internal-winding voice coils that is neighboring a boundary between the two adjacent internal-winding voice coils is the same as that along one side of the internal rectangular coil of the other one of the adjacent internal-winding voice coils that is neighboring the boundary.

3. A loudspeaker, comprising the voice coil assembly according to claim 1, a loudspeaker diaphragm fixed to the voice coil assembly, an edge for supporting the outer periphery of the loudspeaker diaphragm so as to allow vibrations of the loudspeaker diaphragm, and a frame to which the outer periphery of the edge and a magnetic circuit are connected, wherein:

the magnetic circuit includes a plurality of magnets each having a rectangular flat plate thereon, which are magnetized and arranged so that adjacent magnets have different polarities, and a yoke to which the magnets are fixed and which define open holes at opposite ends thereof; and the internal rectangular coils of the voice coil assembly are placed in the magnetic gaps formed between adjacent plates and between the plates and the yoke.

4. A voice coil assembly, comprising a lattice-shaped bobbin having a lattice-shaped cross section and having a plurality of rectangular spaces defined therein, and a plurality of internal rectangular coils fixed to the inner wall surfaces defining the rectangular spaces of the lattice-shaped bobbin, wherein two internal rectangular coils fixed to the inner wall surfaces of two adjacent rectangular spaces neighboring each other with a partition wall therebetween are arranged so that a direction of an audio signal current flow along one side of one internal rectangular coil that is neighboring the partition wall is the same as that along one side of the other internal rectangular coil that is neighboring the partition wall.

5. A loudspeaker, comprising the voice coil assembly according to claim 4, a loudspeaker diaphragm fixed to the voice coil assembly, an edge for supporting the outer periphery of the loudspeaker diaphragm so as to allow vibrations of the loudspeaker diaphragm, and a frame to which the outer periphery of the edge and a magnetic circuit are connected, wherein:

the magnetic circuit includes a plurality of magnets each having a rectangular flat plate thereon, which are magnetized and arranged so that adjacent magnets have different polarities, and a yoke to which the magnets are fixed and which define open holes at opposite ends thereof; and the internal rectangular coils of the voice coil assembly are placed in the magnetic gaps formed between adjacent plates and between the plates and the yoke.

6. A loudspeaker, comprising a voice coil assembly having a plurality of internal-winding voice coils, each including a rectangular bobbin having a rectangular cross section and defining a rectangular space therein and an internal rectangular coil fixed to an inner wall surface of the rectangular bobbin defining the rectangular space, an outer wall surface of the rectangular bobbin of one internal-winding voice coil is adhered and fixed to an outer wall surface of the rectangular bobbin of another internal-winding voice coil, two adjacent internal-winding voice coils, of which the outer wall surfaces of the rectangular bobbins are adhered and fixed to each other, are arranged so that a direction of an audio signal current flow along one side of the internal rectangular coil of one of the adjacent internal-winding voice coils that is neighboring a boundary between the two adjacent internal-winding voice coils is the same as that along one side of the internal rectangular coil of the other one of the adjacent internal-winding voice coils that is neighboring the boundary;

lead wires connected to an input terminal and an output terminal of the plurality of internal-winding voice coils connected together, a loudspeaker diaphragm fixed to the voice coil assembly;

an edge for supporting the outer periphery of the loudspeaker diaphragm so as to allow vibrations of the loudspeaker diaphragm;

a magnetic circuit includes a plurality of magnets each having a rectangular flat plate thereon, which are magnetized and arranged so that adjacent magnets have different polarities, and a yoke to which the magnets are fixed and which define open holes at opposite ends thereof, a terminal being connected to the another ends of the lead wires, a frame to which the outer periphery of the edge and the magnetic circuit and the terminal are connected, wherein:

the internal rectangular coils of the voice coil assembly are placed in the magnetic gaps formed between adjacent plates and between the plates and the yoke, with the outer wall surfaces on opposite ends of the voice coil assembly being exposed through the open holes of the magnetic circuit.

7. The loudspeaker according to claim 6, wherein:

the frame has frame holes which are communicated to the open holes of the magnetic circuit; and the outer wall surfaces on opposite ends of the voice coil assembly are exposed through the open holes of the magnetic circuit and the frame holes.

8. The loudspeaker according to claim 6, further comprising a dust-proof member covering the open holes of the magnetic circuit and the frame holes of the frame.

9. A loudspeaker, comprising a voice coil assembly having a lattice-shaped bobbin having a lattice-shaped cross section and having a plurality of rectangular spaces defined therein, and a plurality of internal rectangular coils fixed to the inner wall surfaces defining the rectangular spaces of the lattice-shaped bobbin, two internal rectangular coils fixed to the inner wall surfaces of two adjacent rectangular spaces neighboring each other with a partition wall therebetween are arranged so that a direction of an audio signal current flow along one side of one internal rectangular coil that is neighboring the partition wall is the same as that along one side of the other internal rectangular coil that is neighboring the partition wall, lead wires connected to an input terminal and an output terminal of the plurality of internal-winding voice coils connected together, a loudspeaker diaphragm fixed to the voice coil assembly;

an edge for supporting the outer periphery of the loudspeaker diaphragm so as to allow vibrations of the loudspeaker diaphragm;

a magnetic circuit includes a plurality of magnets each having a rectangular flat plate thereon, which are magnetized and arranged so that adjacent magnets have different polarities, and a yoke to which the magnets are fixed and which define open holes at opposite ends thereof, a terminal being connected to the another ends of the lead wires, a frame to which the outer periphery of the edge and the magnetic circuit and the terminal are connected, wherein:

the internal rectangular coils of the voice coil assembly are placed in the magnetic gaps formed between adjacent plates and between the plates and the yoke, with the outer wall surfaces on opposite ends of the voice coil assembly being exposed through the open holes of the magnetic circuit.

10. The loudspeaker according to claim 9, wherein:

the frame has frame holes which are communicated to the open holes of the magnetic circuit; and the outer wall surfaces on opposite ends of the voice coil assembly are exposed through the open holes of the magnetic circuit and the frame holes.

11. The loudspeaker according to claim 9, further comprising a dust-proof member covering the open holes of the magnetic circuit and the frame holes of the frame.

12. A voice coil assembly, comprising a lattice-shaped bobbin having a lattice-shaped cross section and having a plurality of rectangular spaces defined therein, and a plurality of internal rectangular coils fixed to the inner wall surfaces defining the rectangular spaces of the lattice-shaped bobbin, two internal rectangular coils fixed to the inner wall surfaces of two adjacent rectangular spaces neighboring each other with a partition wall therebetween are arranged so that a direction of an audio signal current flow along one side x1 of one internal rectangular coil v1 that is neighboring the partition wall is the same as that along one side x2 of the other internal rectangular coil v2 that is neighboring the partition wall, wherein a thickness tb1 of the partition wall of the lattice-shaped bobbin is smaller than a thickness tb2 of other portions of the inner wall surface, and is less than or equal to a total thickness tc0, being a sum of a thickness tc1 of one side x1 of one internal rectangular coil v1 and a thickness tc2 of one side x2 of the other internal rectangular coil v2.

13. The voice coil assembly according to claim 12, wherein the sides x1 and x2 of the two internal rectangular coils v1 and v2 along the partition wall are fixed together by an adhesive with the partition wall being not interposed therebetween, and upper end surfaces of the sides x1 and x2 are fixed to a lower end surface of the partition wall by an adhesive.

14. The voice coil assembly according to claim 12, wherein the partition wall of the lattice-shaped bobbin further includes a partition wall extension being interposed between the sides x1 and x2 of the two internal rectangular coils v1 and v2 along the partition wall, and a thickness tb0 of the partition wall extension is less than or equal to the thickness tb1 of the partition wall.

15. A loudspeaker, comprising the voice coil assembly according to claim 12, a loudspeaker diaphragm fixed to the voice coil assembly, an edge for supporting the outer periphery of the loudspeaker diaphragm so as to allow vibrations of the loudspeaker diaphragm, and a frame to which the outer periphery of the edge and a magnetic circuit are connected, wherein:

the magnetic circuit includes a plurality of magnets each having a rectangular flat plate thereon, which are magnetized and arranged so that adjacent magnets have different polarities, and a yoke to which the magnets are fixed and which define open holes at opposite ends thereof; and the internal rectangular coils of the voice coil assembly are placed in the magnetic gaps formed between adjacent plates and between the plates and the yoke.

16. A magnetic circuit module having a plurality of magnets whose direction of magnetization is opposite to that of the adjacent magnet being arranged on a plate portion, for defining a magnetic circuit for a loudspeaker, comprising;

a generally rectangular flat plate, a main magnet being fixed to a bottom surface of the plate, a yoke being fixed to a bottom surface of the main magnet, the yoke includes a side wall portion forming a generally straight magnetic gap Ga between the side wall portion and one side of the generally rectangular plate, and a connecting portion that is connected to the yoke of an adjacent magnetic circuit module, wherein the plates of the magnetic circuit modules each connecting portion are connected to form generally straight magnetic gaps Gb, which are communicated to and perpendicular to the magnetic gap Ga.

17. The magnetic circuit module according to claim 16, further including;

a repulsive magnet being fixed to the upper surface of the plate.

18. A magnetic circuit for a loudspeaker, comprising;

a plurality of magnetic circuit modules according to 16, and a flame being connected to the yokes of the magnetic circuit modules.

19. A loudspeaker, comprising;

a magnetic circuit including the magnetic circuit module according to 16, a frame to which the magnetic circuit being connected, vibration member which the outer periphery is connected the flame, wherein the vibration member have a loudspeaker diaphragm, an edge for supporting the outer periphery of the loudspeaker diaphragm so as to allow vibrations of the loudspeaker diaphragm, a bobbin being fixed to a back surface side of the diaphragm, a plurality of rectangular coils being fixed to the bobbin, wherein a plurality of rectangular coils are placed in the magnetic gaps Ga and Gb.

* * * * *